US006629910B1

(12) United States Patent
Krull

(10) Patent No.: US 6,629,910 B1
(45) **Date of Patent: *Oct. 7, 2003**

(54) ADJUSTABLE WEIGHT EXERCISE APPARATUS

(76) Inventor: Mark A. Krull, P.O. Box 57, Greencastle, IN (US) 46135

( * ) Notice: Subject to any disclaimer, the term of this patent is extended or adjusted under 35 U.S.C. 154(b) by 0 days.

This patent is subject to a terminal disclaimer.

(21) Appl. No.: 09/519,269

(22) Filed: Mar. 7, 2000

Related U.S. Application Data

(63) Continuation of application No. 08/939,845, filed on Sep. 29, 1997, now Pat. No. 6,033,350, which is a continuation-in-part of application No. 08/866,607, filed on Jul. 1, 1997, now Pat. No. 5,876,313.

(60) Provisional application No. 60/022,196, filed on Jul. 19, 1996.

(51) Int. Cl.[7] ..... A63B 21/06; A63B 21/072

(52) U.S. Cl. ..... 482/98; 482/107; 482/108

(58) Field of Search ..... 482/98, 94, 93, 482/97, 99, 106–109

(56) References Cited

U.S. PATENT DOCUMENTS

| | | | | | |
|---|---|---|---|---|---|
| 1,779,594 | A | * | 10/1930 | Hall | 482/107 |
| 4,529,198 | A | * | 7/1985 | Hettick, Jr. | 272/123 |
| 4,982,957 | A | * | 1/1991 | Shields | 272/123 |
| 5,062,631 | A | * | 11/1991 | Dau et al. | 482/107 |
| 5,344,375 | A | * | 9/1994 | Cooper | 482/106 |
| 5,876,313 | A | * | 3/1999 | Krull | 482/98 |
| 6,033,350 | A | * | 3/2000 | Krull | 482/98 |

FOREIGN PATENT DOCUMENTS

| | | | | |
|---|---|---|---|---|
| EP | 0177643 | * | 4/1986 | 482/99 |
| FR | 2613237 A1 | * | 10/1988 | 482/99 |

* cited by examiner

*Primary Examiner*—Mickey Yu
*Assistant Examiner*—Victor Hwang

(57) ABSTRACT

Weights are disposed on opposite sides of a base member, and selector rods are selectively moved into engagement with the desired number of weights on each side of the base member. The resulting adjustable resistance assembly may be used on dumbbells and/or weight stacks.

20 Claims, 34 Drawing Sheets

838a
838b
812

800
821
810a
810b
822
823
824
825
826
827
827
828
829
830
831
813
809a
809b
808

Fig. 40
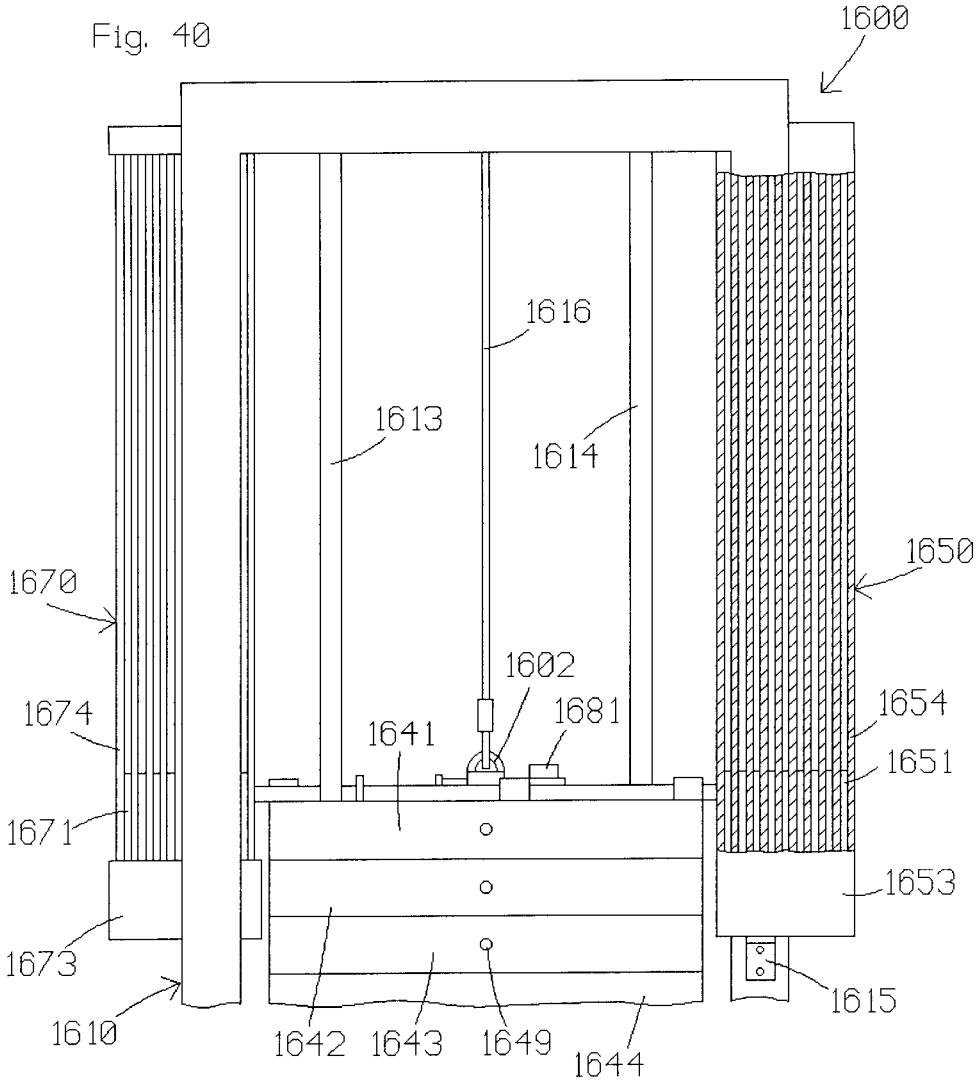
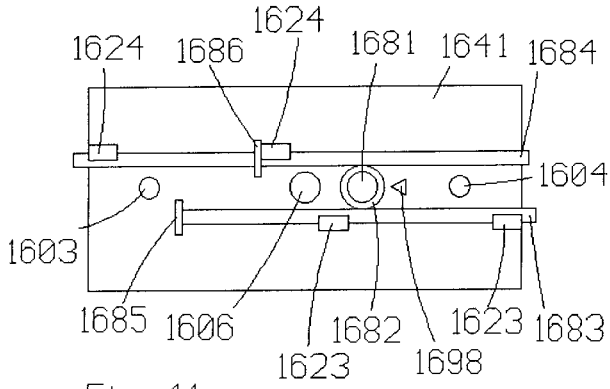
Fig. 41

Fig. 42
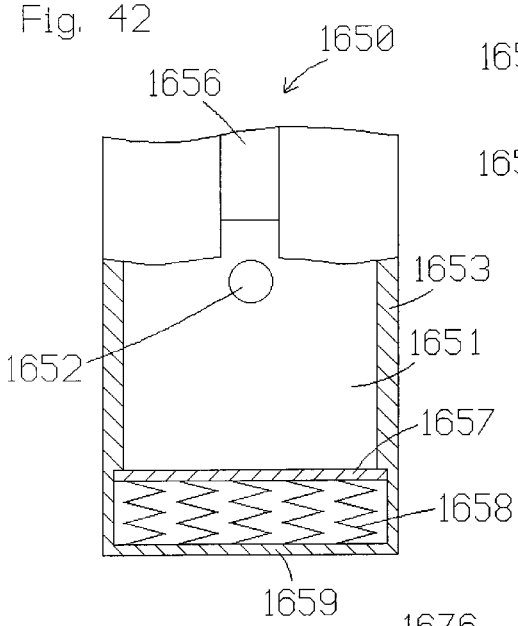
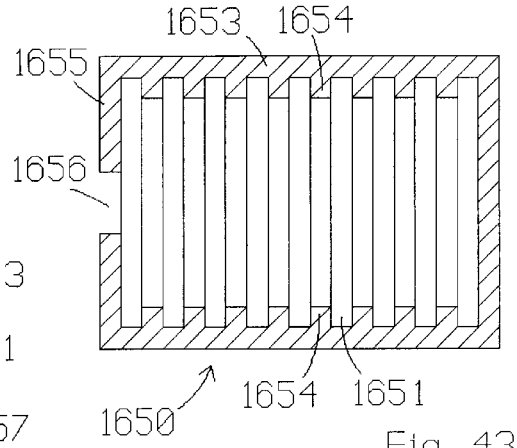
Fig. 43
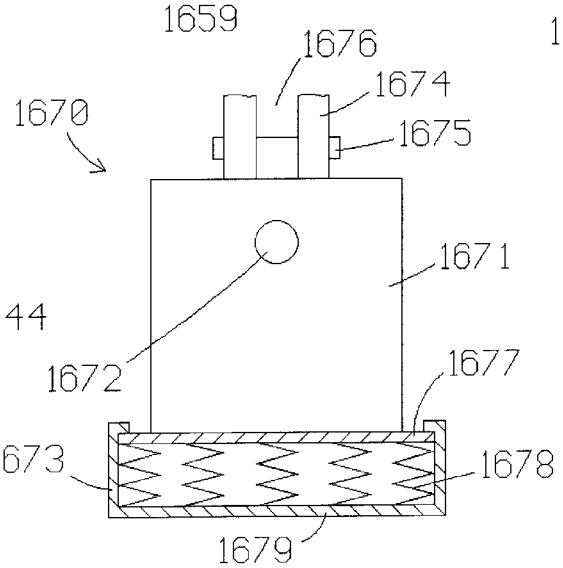
Fig. 44
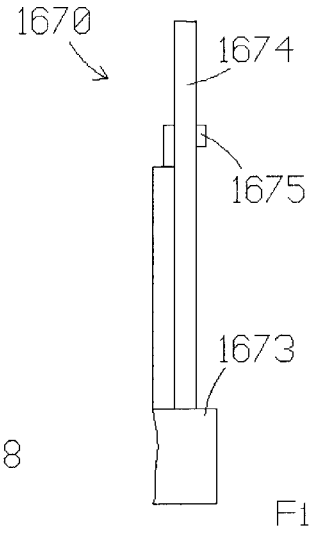
Fig. 45

Fig. 46
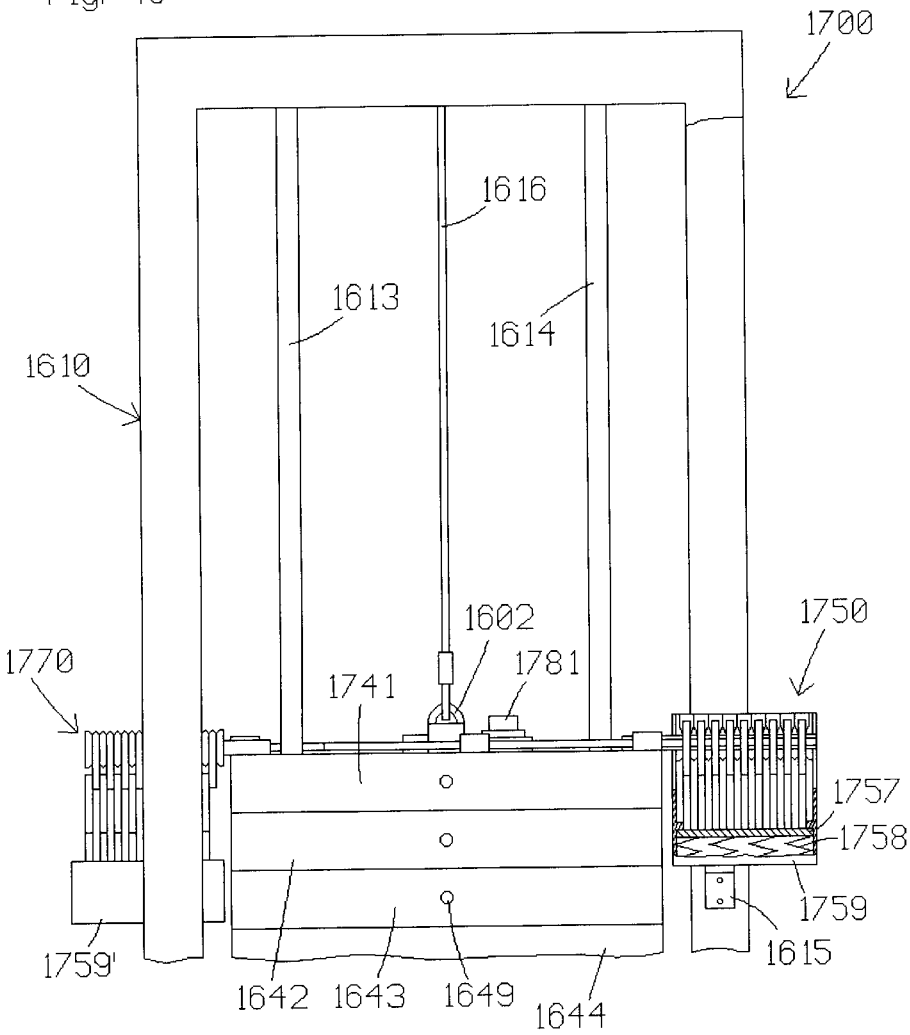
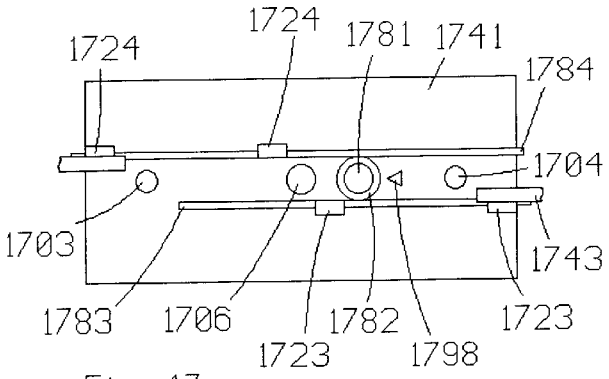
Fig. 47

Fig. 48
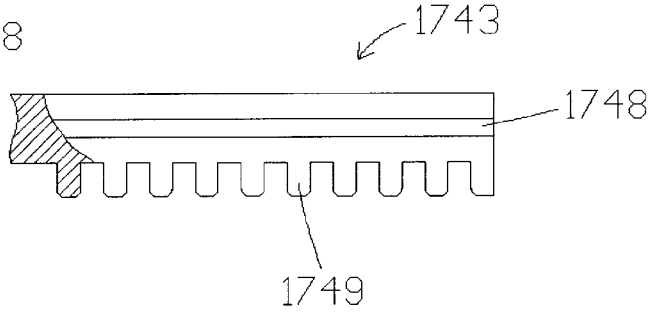
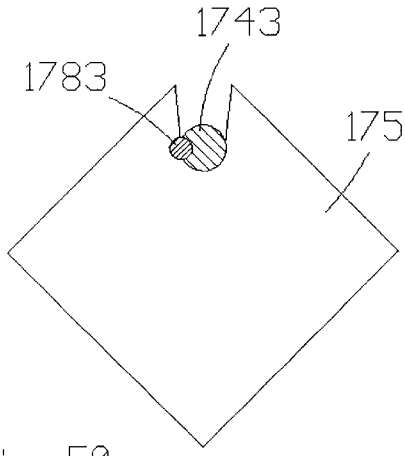
Fig. 50
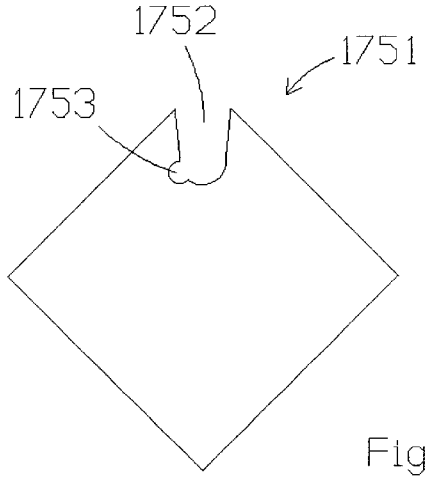
Fig. 49
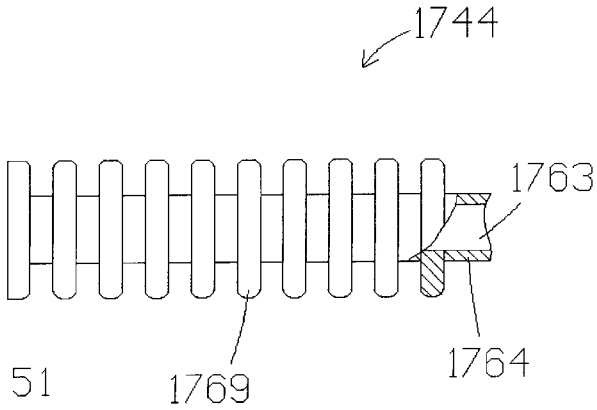
Fig. 51

Fig. 56
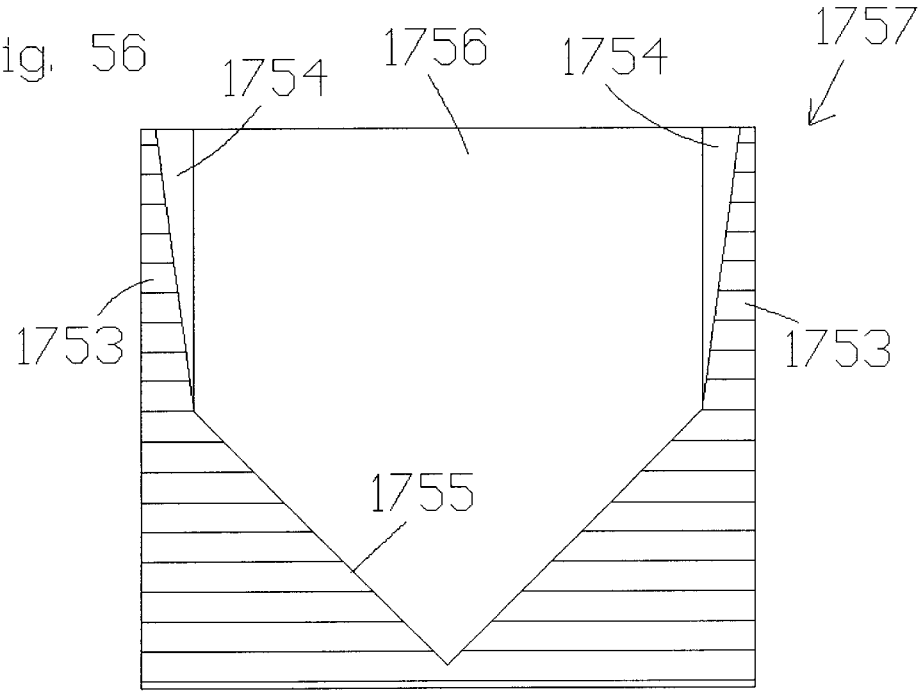
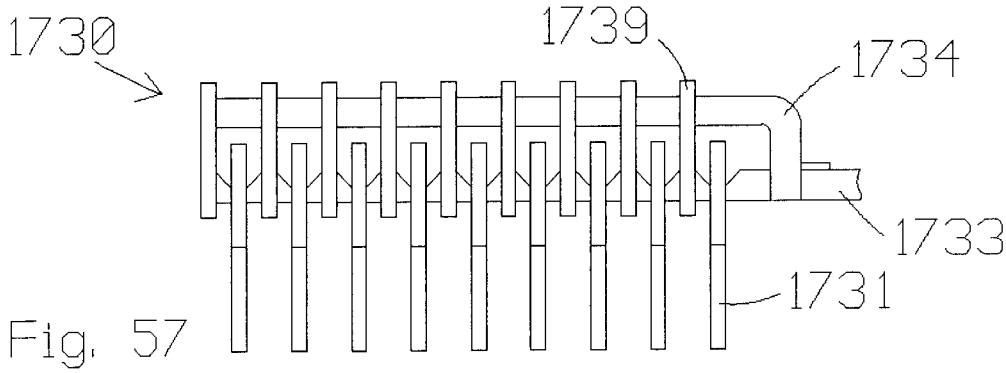
Fig. 57
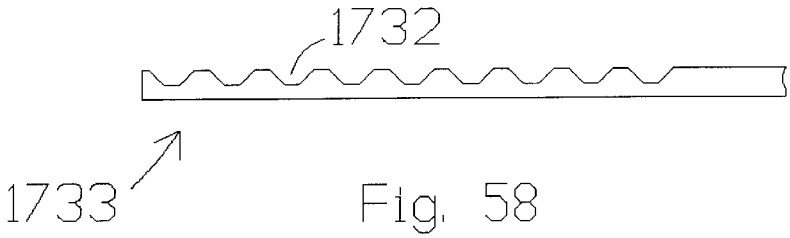
Fig. 58

Fig. 60
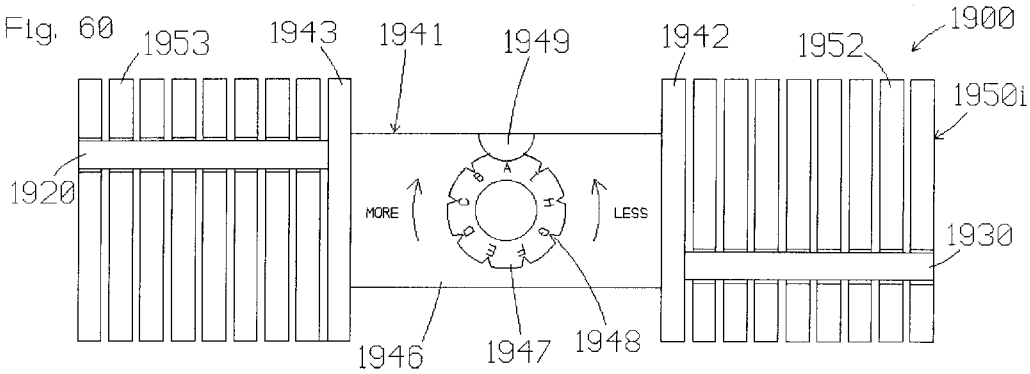
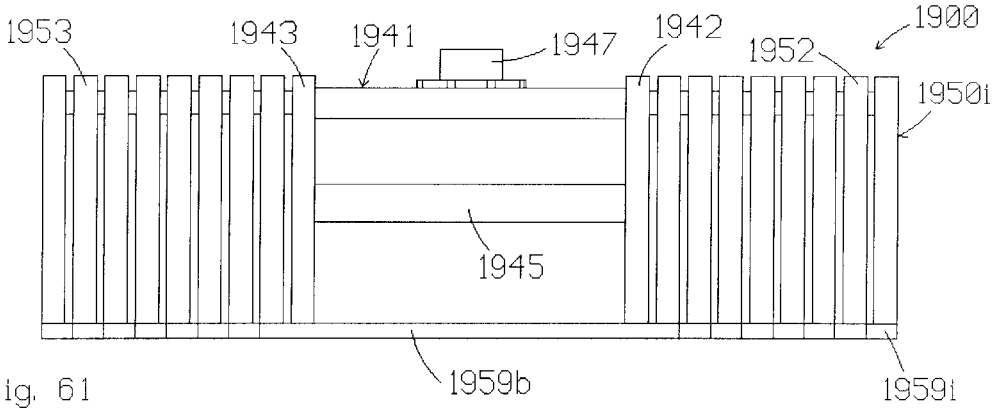
Fig. 61
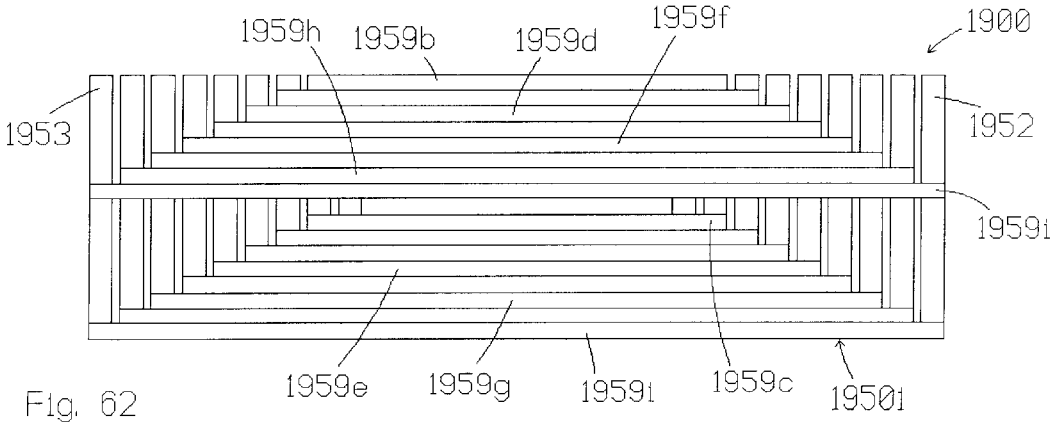
Fig. 62

Fig. 68
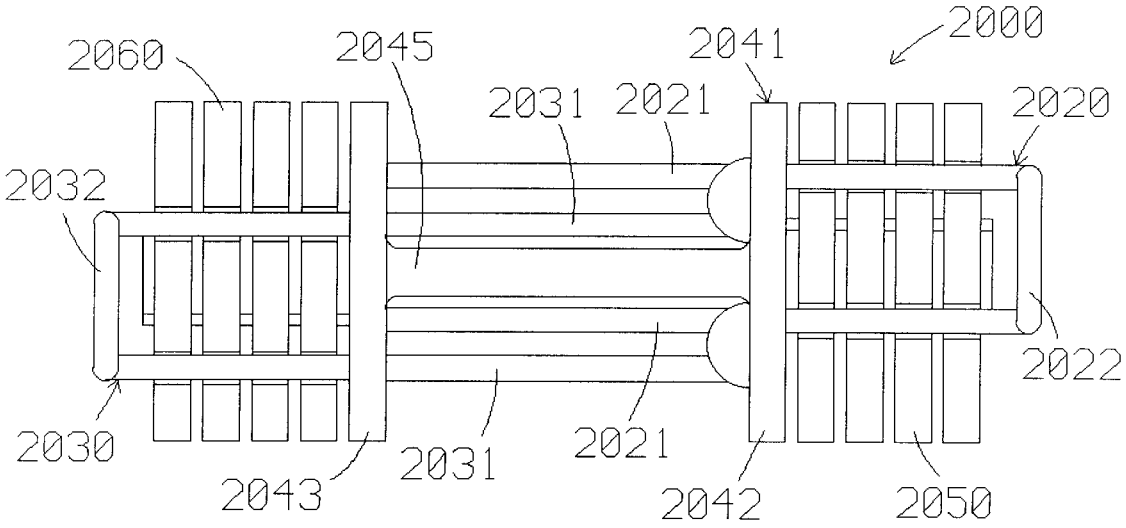
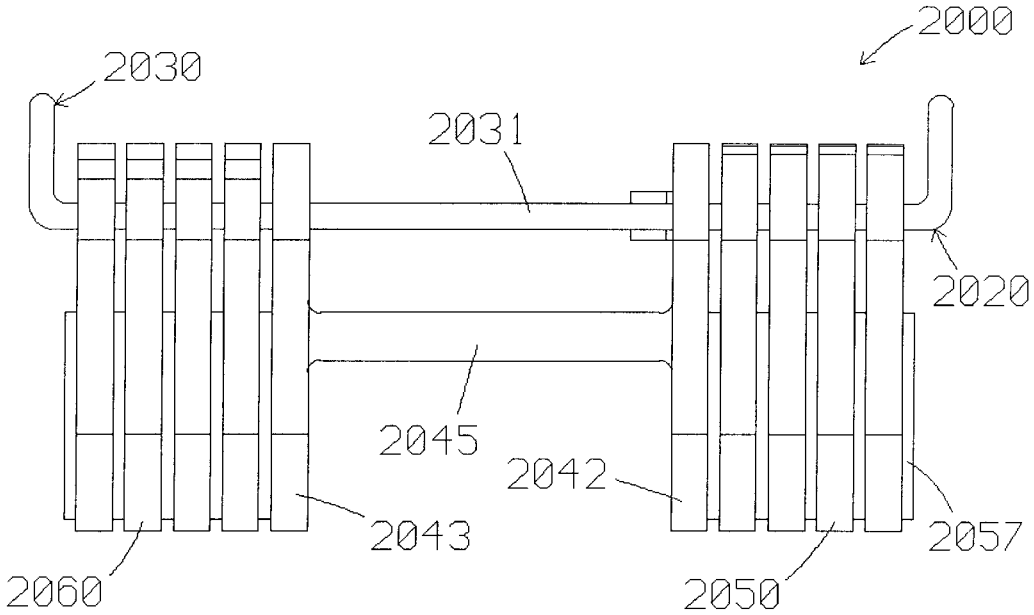
Fig. 69

Fig. 73
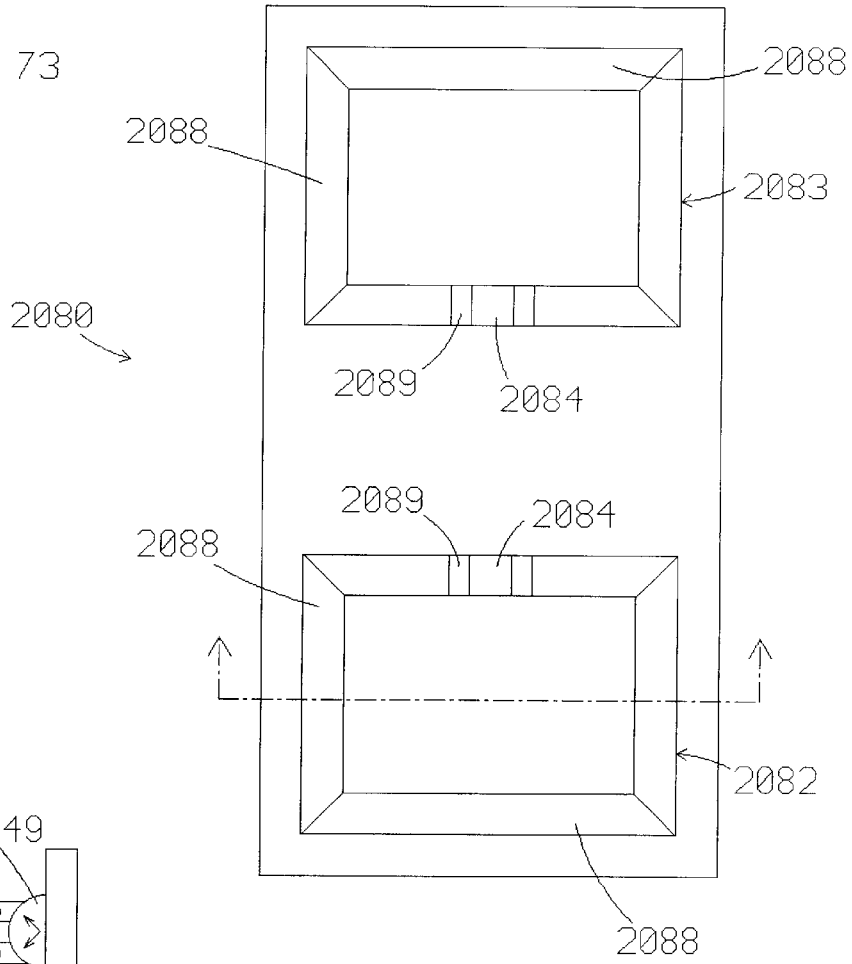
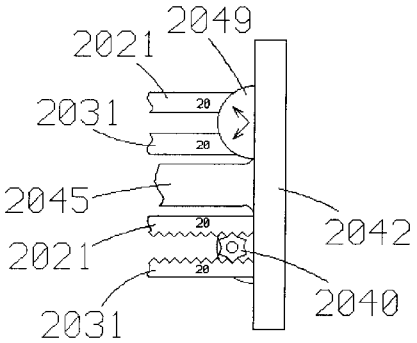
Fig. 75
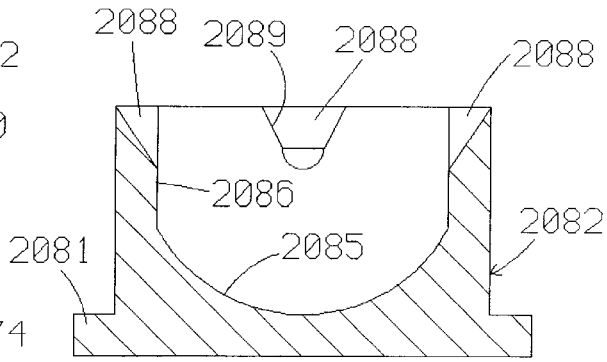
Fig. 74

Fig. 76
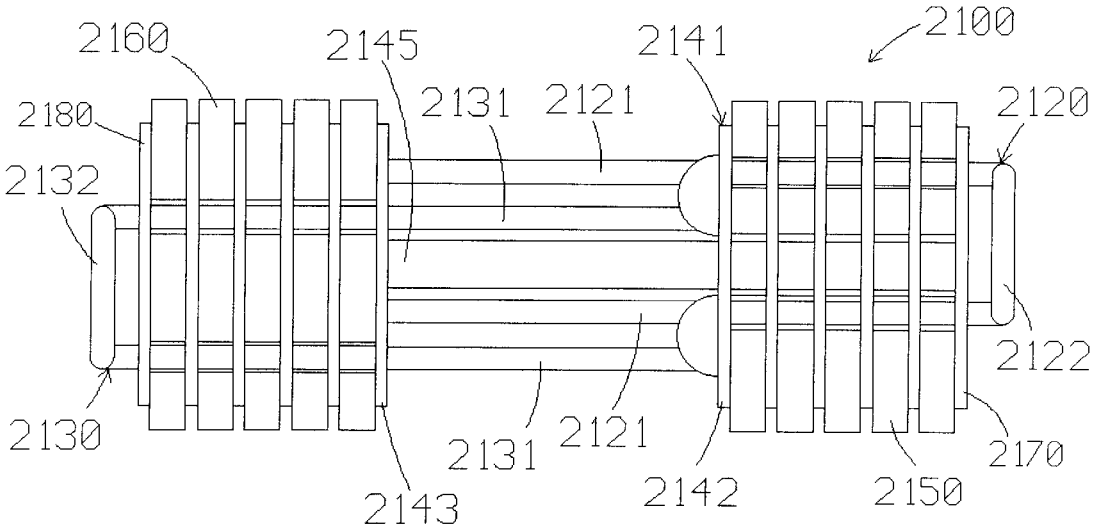
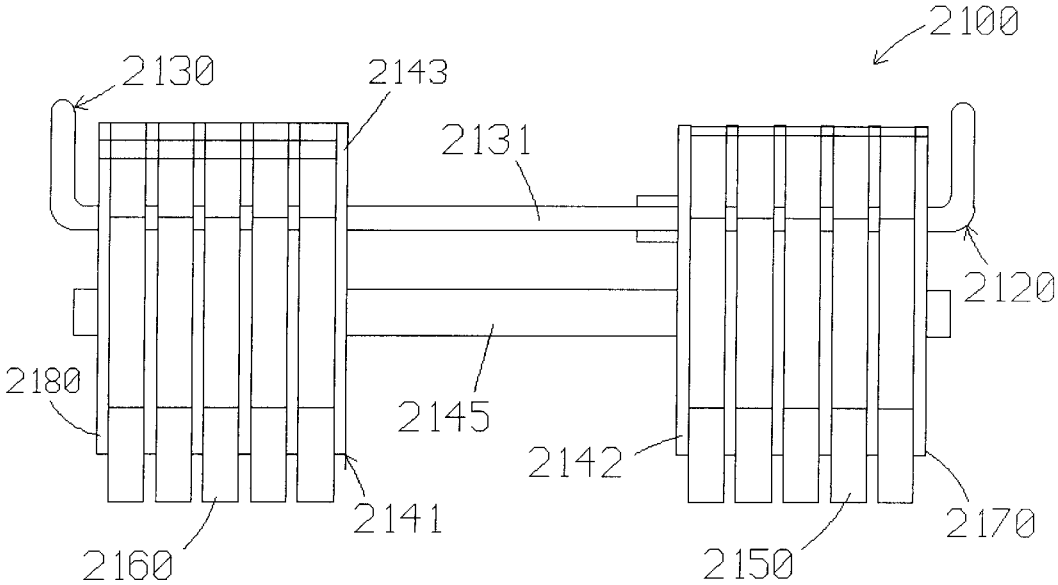
Fig. 77

ADJUSTABLE WEIGHT EXERCISE APPARATUS

CROSS-REFERENCE TO RELATED APPLICATION

This application is a continuation of U.S. patent application Ser. No. 08/939,845, filed Sep. 29, 1997, now U.S. Pat. No. 6,033,350, which is a continuation-in-part of U.S. patent application Ser. No. 08/866,607, filed Jul. 1, 1997, now U.S. Pat. No. 5,876,313, which claims the benefit of U.S. Provisional Application No. 60/022,196, filed Jul. 19, 1996.

FIELD OF THE INVENTION

The present invention relates to exercise equipment and more particularly, to weight-based resistance to exercise movement.

BACKGROUND OF THE INVENTION

Exercise weight stacks are well known in the art and prevalent in the exercise equipment industry. Generally speaking, a plurality of weights or plates are arranged in a stack and maintained in alignment by guide members or rods. A desired amount of weight is engaged by selectively connecting a selector rod to the appropriate weight in the stack. The selector rod and/or the uppermost weight in the stack are/is connected to at least one force receiving member by means of a connector. The engaged weight is lifted up from the stack in response to movement of the force receiving member.

Some examples of conventional weight stacks, their applications, and/or features are disclosed in U.S. Pat. No. 3,912,261 to Lambert, Sr. (shows an exercise machine which provides weight stack resistance to a single exercise motion); U.S. Pat. No. 5,263,915 to Habing (shows an exercise machine which uses a single weight stack to provide resistance to several different exercise motions); U.S. Pat. No. 4,900,018 to Ish III, et al. (shows an exercise machine which provides weight stack resistance to a variety of exercise motions); U.S. Pat. No. 4,878,663 to Luquette (shows an exercise machine which has rigid linkage members interconnected between a weight stack and a force receiving member); U.S. Pat. No. 4,601,466 to Lais (shows bushings which are attached to weight stack plates to facilitate movement along conventional guide rods); U.S. Pat. No. 5,374,229 to Sencil (shows an alternative to conventional guide rods); U.S. Pat. No. 4,878,662 to Chern (shows a selector rod arrangement for clamping the selected weights together into a collective mass); U.S. Pat. No. 4,809,973 to Johns (shows telescoping safety shields which allow insertion of a selector pin but otherwise enclose the weight stack); U.S. Pat. No. 5,000,446 to Sarno (shows discrete selector pin configurations intended for use on discrete machines); U.S. Pat. No. 4,546,971 to Raasoch (shows levers operable to remotely select a desired number of weights in a stack); U.S. Pat. No. 5,037,089 to Spagnuolo et al. (shows a controller operable to automatically adjust weight stack resistance); U.S. Pat. No. 4,411,424 to Barnett (shows a dual-pronged pin which engages opposite sides of a selector rod); U.S. Pat. No. 1,053,109 to Reach (shows a stack of weight plates, each having a slide which moves into and out of engagement with the weight plate or top plate above it); and U.S. Pat. No. 5,306,221 to Itaru (shows a stack of weight plates, each having a lever which pivots into and out of engagement with a selector rod). Despite these advances and others in the weight stack art, room for improvement and ongoing innovation continues to exist.

Exercise dumbbells are also well known in the art and prevalent in the exercise equipment industry. Generally speaking, each dumbbell includes a handle and a desired number of weights or plates which are secured to opposite sides of the handle. The dumbbell is lifted up subject to gravitational force acting on the mass of the handle and attached weights. An example of an adjustable weight dumbbell is disclosed in U.S. Pat. No. 5,637,064 to Olson et al. (shows a dumbbell assembly having a plurality of weights which are stored in nested relationship to one another and selectively connected to a handle).

SUMMARY OF THE INVENTION

One aspect of the present invention is to move selector rods in opposite directions relative to a base member in order to selectively engage weight plates disposed on opposite sides of the base member. This adjustable weight assembly may be used on dumbbells and/or on weight stack machines (in the latter case, either alone or in combination with a rotating selector rod assembly also constructed in accordance with the principles of the present invention). Many of the features and advantages of the present invention will become apparent to those skilled in the art from the more detailed description that follows.

BRIEF DESCRIPTION OF THE FIGURES OF THE DRAWING

With reference to the Figures of the Drawing, wherein like numerals represent like parts and assemblies throughout the several views.

FIG. 40 is a partially sectioned, front view of an exercise weight stack constructed according to the principles of the present invention;

FIG. 41 is a top view of a top plate on the weight stack of FIG. 40;

FIG. 42 is a partially sectioned, end view of a first supplemental weight assembly on the weight stack of FIG. 40;

FIG. 43 is a partially sectioned, top view of the weight assembly of FIG. 42;

FIG. 44 is a partially sectioned, end view of a second supplemental weight assembly on the weight stack of FIG. 40;

FIG. 45 is a more detailed front view of part of the weight assembly of FIG. 44;

FIG. 46 is a partially sectioned, front view of another exercise weight stack constructed according to the principles of the present invention;

FIG. 47 is a top view of a top plate on the weight stack of FIG. 46;

FIG. 48 is a partially sectioned, front view of a part of a first supplemental weight assembly on the weight stack of FIG. 46;

FIG. 49 is an end view of another part of the first supplemental weight assembly on the weight stack of FIG. 46;

FIG. 50 is a partially sectioned, end view of the parts of FIGS. 48 and 49 keyed together;

FIG. 51 is a partially sectioned, front view of a part of a second supplemental weight assembly on the weight stack of FIG. 46;

FIG. 56 is an end view of yet another part of the weight stack of FIG. 46;

FIG. 57 is a front view of another supplemental weight assembly suitable for use on an exercise weight stack;

FIG. 58 is a front view of a part of the weight assembly of FIG. 57;

FIG. 60 is a top view of part of a dumbbell constructed according to the principles of the present invention;

FIG. 61 is a front view of the dumbbell of FIG. 60 in its entirety;

FIG. 62 is a bottom view of the dumbbell of FIG. 60 in its entirety;

FIG. 68 is a top view of another dumbbell constructed according to the principles of the present invention;

FIG. 69 is a front view of the dumbbell of FIG. 68;

FIG. 73 is a top view of a housing or stand for the dumbbell of FIGS. 68–69;

FIG. 74 is a sectioned end view of the housing of FIG. 73;

FIG. 75 is a partially sectioned, top view of a portion of the dumbbell of FIGS. 68–69;

FIG. 76 is a top view of yet another dumbbell constructed according to the principles of the present invention;

FIG. 77 is a front view of the dumbbell of FIG. 76;

DETAILED DESCRIPTION OF A PREFERRED EMBODIMENT

The present invention provides methods and apparatus which facilitate exercise involving the movement of weights subject to gravitational force. Generally speaking, the present invention allows a person to adjust weight resistance by moving one or more selector rods into engagement with a desired number of weights. The present invention may be applied to exercise weight stacks and/or free weight assemblies such as dumbbells.

Figure 38:
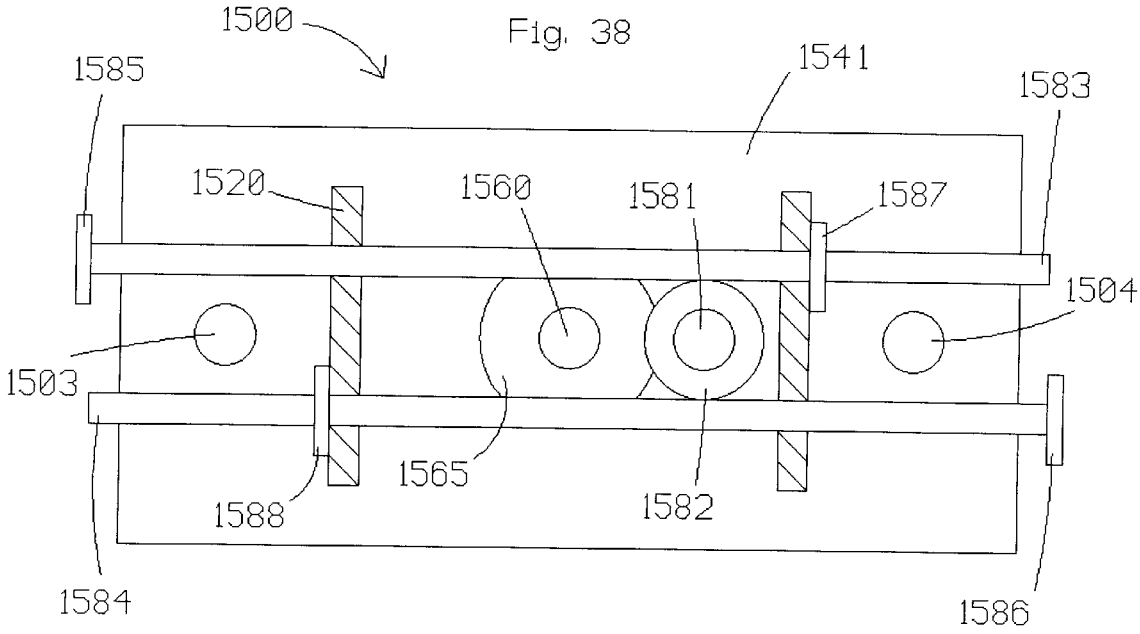
FIG. 38 is a top view of a top weight stack plate constructed according to the principles of the present invention.
Figure 39:
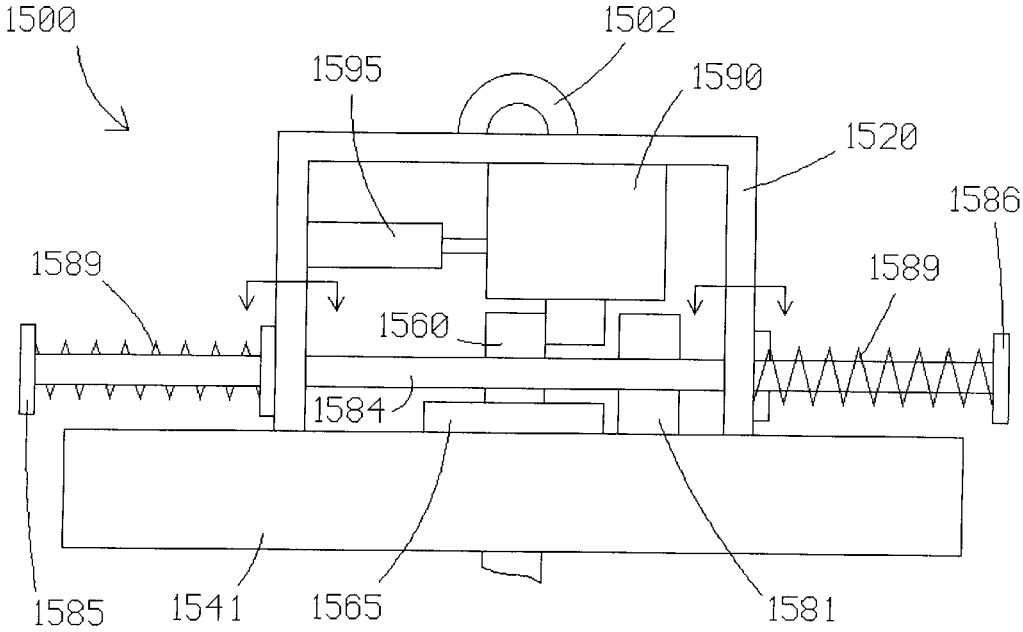
FIG. 39 is a front view of the top weight stack plate of FIG. 38.

FIGS. 38–39 show an assembly 1500 constructed according to the principles of the present invention. The assembly 1500 includes a base member or plate 1541 which is sized and configured to function as the top plate in a weight stack. Holes 1503 and 1504 are formed through the plate 1541 and cooperate with guide rods in a manner known in the art. A central hole is formed through the plate 1541 to receive a selector rod 1560 constructed according to the principles of the present invention. A disc 1565 cooperates with another disc (disposed within a cavity in the plate 1541) to rotatably mount the selector rod 1560 to the plate 1541.

As explained below with reference to FIGS. 1–37, the selector rod 1560 (or a suitable alternative) is selectively rotatable into and out of engagement with weights stacked beneath the plate 1541.

A bracket 1520 is rigidly mounted on the plate 1541 and spans a substantial portion thereof. A catch 1502 is rigidly mounted on top of the bracket 1520 and connects to a force transmitting cable in a manner known in the art. Holes are formed through opposite walls of the bracket 1520 to receive and support first and second selector rods 1583 and 1584. As explained below with reference to FIGS. 40–81, the rods 1583 and 1584 (or suitable alternatives) are selectively movable into and out of engagement with weights disposed on opposite sides of the plate 1541.

An optional motor 1590 is movably connected to the bracket 1520 and operable to selectively drive the selector rod 1560 and the rods 1583 and 1584. A linear actuator 1595, or other suitable member, is interconnected between the bracket 1520 and the motor 1590 and operable to move the latter relative to the former. When the actuator 1595 is relatively retracted, an output shaft on the motor 1590 engages or bears against the selector rod 1560. When the motor 1590 occupies this first position relative to the plate 1541, operation of the motor 1590 results in rotation of the selector rod 1560.

When the actuator 1595 is relatively extended, the output shaft on the motor 1590 disengages the selector rod 1560 and engages or bears against a first portion 1581 of an idler wheel which is rotatably mounted on the plate 1541. When the motor occupies this second position relative to the plate 1541, operation of the motor 1590 results in rotation of the idler wheel. A second, discrete portion 1582 of the idler wheel engages or bears against each of the rods 1583 and 1584, so that rotation of the idler wheel relative to the plate 1541 causes the rods 1583 and 1584 to move in opposite directions relative to the plate 1541. Those skilled in the art will recognize that compatible gear teeth may be disposed on the interengaging portions of the output shaft, the selector rod 1560, the idler wheel portions 1581 and 1582, and the rods 1583 and 1584, in order to facilitate the transfer of motion therebetween.

In a preferred embodiment, the underlying weights are relatively heavy (e.g. thirty pounds each), and the opposite side weights are relatively light (e.g. three pounds each). The provision of six thirty-pound weights beneath the top plate and four three-pound weights to each side of the top plate, together with a thirty pound top plate, provides resistance to exercise which (i) ranges from thirty pounds to two hundred and thirty-four pounds and (ii) is adjustable in three or six pound increments (depending on whether opposite side weights are engaged in pairs or individually). In the event that a counterweight is provided to offset the weight of the top plate, the same weights would provide resistance to exercise ranging from zero pounds to two hundred and four pounds.

One way to select a desired amount of weight will be described with reference to the foregoing collection of weights and a motorized version of the present invention. In such a scenario, data indicating a desired amount of weight is entered into a controller via a keypad, a machine readable card, a voice recognition device, a switch on a force receiving member, or any other suitable means. The controller compares the desired amount of weight to the currently selected amount of weight. If the two values are equal (or within the minimum available adjustment of one another), then the controller simply indicates that the desired amount of weight is engaged. Otherwise, the controller divides the desired amount of weight by the larger weight increment (thirty) to obtain a quotient. The controller then rounds down the quotient to obtain a first integer value and determines whether the selector rod should be rotated. If so, then the controller moves the motor output shaft into engagement with the selector rod and rotates the selector rod to engage the appropriate number of underlying weights. Thereafter, the controller subtracts the first integer value from the quotient to obtain a remainder and divides the remainder by the smaller weight increment (three). The controller then rounds off to obtain a second integer value and determines whether the rods should be moved. If so, then the controller moves the motor output shaft into engagement with the idler wheel and moves the rods into engagement with the appropriate number of opposite side weights. After any and all adjustments have been made, the controller indicates that the desired amount of weight is engaged.

In FIG. 39, the selector rods 1583 and 1584 are shown with optional heads 1585 and 1586, stops 1587 and 1588, springs 1589. The springs 1589 cooperate with the bracket 1520 and respective heads 1585 and 1586 to bias respective rods 1583 and 1584 toward retracted (or disengaged) positions relative to their respective side weights. The stops 1587 and 1588 cooperate with the bracket 1520 to limit travel of respective rods 1583 and 1584 in the "retracted" direction. Recognizing that the springs 1589 are operable to move the rods 1583 and 1584 in the opposite direction, and that the selector rod 1560 can be rotated beyond a full revolution with no adverse effect, an advantage of this "biased" arrangement is that the motor is required to operate in only a single direction, so long as its output shaft resists rotation and remains engaged with the idler wheel during exercise.

The subject invention involves (i) the selection of weights disposed on opposite sides of a base member and/or (ii) the selection of weights disposed beneath a base member. Those skilled in the art will recognize that these aspects of the invention may be practiced individually or together. The foregoing description with reference to FIGS. 38–39 suggests how these two aspects of the invention may be combined in a single embodiment, while the descriptions that follow set forth several examples wherein each invention is implemented separately. Those skilled in the art will recognize that the features of the various embodiments may be mixed and matched to arrive at additional embodiments and/or combinations of selection processes.

Selection of Weights Adjacent a Base Member

FIGS. 40–81 show various ways to selectively engage weights disposed on opposite sides of a base member or top plate. FIGS. 40–59 demonstrate several methods with reference to weight stack embodiments, and FIGS. 60–81 demonstrate several methods with reference to dumbbell embodiments.

Weight Stack Examples

As shown in FIG. 40, an exercise weight stack 1600 generally includes a frame 1610, a base member 1641, weights 1642–1644 underlying the base member 1641, and weights 1651 and 1671 disposed on opposite sides of the base member 1641. Holes 1603 and 1604 are formed through the base member 1641 (and through the weights 1642–1644) to accommodate respective guide rods 1613 and 1614. Another hole 1606 is formed through the base member 1641 (and through the weights 1642–1644) to accommodate a selector rod of the type known in the art and rigidly secured to the top plate 1641. Transverse holes are formed through the selector rod and align with transverse holes 1649 through the weights 1642–1644 to accommodate a selector pin. One end of a cable 1616 is connected to the selector rod by means of a catch 1602. An opposite end of the cable 1616 is connected to a force receiving member (not shown).

A knob 1681 and a gear 1682 are mounted on the base member 1641 and rotate together about a common axis of rotation relative to the base member 1641. Diametrically opposed portions of the gear 1682 engage respective rods 1683 and 1684 which are movably mounted on the base member 1641 by means of respective supports 1623 and 1624. Gear teeth are provided on the rods 1683 and 1684 to engage the teeth on the gear 1682 in such a manner that rotation of the latter causes the former to move in opposite directions relative to the base member 1641. Stops 1685 and 1686 are provided on respective rods 1683 and 1684 to limit their travel relative to the base member 1641. An indicator 1698 is provided on the base member 1641 to cooperate with indicia on the knob 1681 and/or the gear 1682 to indicate the orientation of both relative to the base member 1641.

The rod 1683 is movable into engagement with weights 1651 disposed in a first supplemental weight assembly 1650 which is mounted on the frame 1610 to the right of the base member 1641 (as shown in FIG. 40). Brackets 1615 rigidly connect upper and lower ends of the weight assembly 1650 to the frame 1610.

Portions of the weight assembly 1650 are shown in greater detail in FIGS. 42–43. The weights 1651 are disposed between opposite sidewalls 1653 and spaced apart from one another by inwardly extending projections 1654. In other words, the projections 1654 and the sidewalls 1653 cooperate to define channels which constrain the weights 1651 to move through a particular path. A front wall 1655 faces the base member 1641 and provides a slot 1656 to accommodate travel of the selector rod 1683 through the same particular path as the weights 1651.

The weights 1651 are supported from below by a shock absorbing platform 1657 which is movably mounted between the sidewalls 1653. A bottom wall 1659 is rigidly secured between the sidewalls 1653, and springs 1658 are compressed between the bottom wall 1659 and the platform 1657. The springs 1658 bias the platform 1657 upward against shoulders projecting inward from the sidewalls 1653. A hole 1652 is formed through each weight 1651 to receive the selector rod 1683 when both the base member 1641 and the weights 1651 are at rest. The shock absorbing platform 1657 is provided to accommodate downward impact which might occur at the conclusion of an exercise stroke.

Those skilled in the art will recognize that the assembly 1650 holds the weights 1651 in place prior to selection; keeps the weights 1651 spaced apart to ensure proper selection; supports the weights 1651 during exercise motion; and returns the weights 1651 to their proper location at the conclusion of exercise motion.

The other rod 1684 is movable into engagement with weights 1671 disposed in a second supplemental weight assembly 1670 which is mounted on the frame 1610 to the left of the base member 1641 (as shown in FIG. 40). The weight assembly 1670 may be connected to the frame 1610 by brackets 1615 or any other suitable means.

Portions of the weight assembly 1670 are shown in greater detail in FIGS. 44–45. A plastic guide member 1675 is rigidly secured to each of the weights 1671 by screws or other suitable means. Each guide member 1675 is sized and configured to travel between a pair of rails or strips 1674 which extend substantially from the top to the bottom of the assembly 1670. Whether rigid or merely taut, the rails 1674 cooperate with the guide members 1675 to constrain the weights 1671 to move through a bounded path.

Each pair of rails 1674 defines a slot 1676 therebetween to accommodate a respective guide member 1675 and the selector rod 1684. An intermediate portion of the guide member 1675 rides within the slot 1676, and upper, distal portions of the guide member 1675 are disposed on a side of the rails 1674 opposite the weight 1671.

As in the first assembly 1650, the weights 1671 in the assembly 1670 are supported from below by a shock absorbing platform 1677 which is movably mounted between opposing sidewalls 1673. A bottom wall 1679 is rigidly secured between the sidewalls 1673, and springs 1678 are compressed between the bottom wall 1679 and the platform 1677. The springs 1678 bias the platform 1677 upward against flanges projecting inward from the sidewalls 1673. A hole 1672 is formed through each weight 1671 to receive the selector rod 1673 when both the base member 1641 and the weights 1671 are at rest. The shock absorbing platform 1677 accommodates downward impact which might occur at the end of an exercise stroke.

Those skilled in the art will recognize that the assembly 1670 holds the weights 1671 in place prior to selection; keeps the weights 1671 spaced apart to ensure proper selection; supports the weights 1671 during exercise motion; and returns the weights 1671 to their proper location at the conclusion of exercise motion. Those skilled in the art will also recognize that no significance should be attributed to the depiction of both assemblies 1650 and 1670 on a single machine and/or without motorized adjustment and/or without a rotating selector rod. All such combinations are clearly within the scope of the present invention.

FIGS. 46–55 show two additional ways to selectively engage weights disposed on opposite sides of a base member or top plate. As shown in FIG. 46, an exercise weight stack 1700 generally includes a frame 1610, a base member 1741, weights 1642–1644 underlying the base member 1741, and weight assemblies 1750 and 1770 disposed on opposite sides of the base member 1741. Holes 1703 and 1704 are formed through the base member 1741 (and through the weights 1642–1644) to accommodate respective guide rods 1613 and 1614. Another hole 1706 is formed through the base member 1741 (and through the weights 1642–1644) to accommodate a selector rod of the type known in the art and fastened to the top plate 1741. Transverse holes are formed through the selector rod and align with transverse holes 1649 through the weights 1642–1644 to accommodate a selector pin. One end of a cable 1616 is connected to the selector rod by means of a catch 1602. An opposite end of the cable 1616 is connected to a force receiving member.

A knob 1781 and a gear 1782 are mounted on the base member 1741 and rotate together about a common axis of rotation relative to the base member 1741. Diametrically opposed portions of the gear 1782 engage respective rods 1783 and 1784 which are movably mounted on the base member 1741 by means of respective supports 1723 and 1724. Gear teeth are provided on the rods 1783 and 1784 to engage the teeth on the gear 1782 in such a manner that rotation of the latter causes the former to move in opposite directions relative to the base member 1741. In lieu of the stops on the previous embodiments, the gear teeth are disposed only on discrete portions of the rods 1783 and 1784 so as to limit travel of the rods 1783 and 1784 relative to the base member 1741. An indicator 1798 is provided on the base member 1741 to cooperate with indicia on the knob 1781 and/or the gear 1782 to indicate the orientation of both relative to the base member 1741.

On the right side of the apparatus 1700, a bar 1743 is rigidly secured to the base member 1741 and spans the weight assembly 1750. As shown in FIG. 48, a groove 1748 extends the length of the bar 1743, and fingers 1749 project downward from the bar 1743. The profile of the groove 1748 has a radius of curvature comparable to that of the rod 1783. As shown in FIG. 49, an upwardly opening slot 1752 is formed in each weight 1751 in the assembly 1750 to accommodate the bar 1743. The fingers 1749 on the bar 1743 insert between the weights 1751 to maintain proper spacing therebetween. A notch 1753 is formed in each weight 1751 proximate the lower end of the slot 1752. The notch 1753 has a radius of curvature comparable to that of the groove 1748 and cooperates therewith to define a keyway sized and configured to receive the rod 1783, as shown in FIG. 50.

The supplemental weight assembly 1750 is mounted on the frame 1610 to the right of the base member 1741 (as shown in FIG. 46). Brackets 1615 rigidly connect the opposite sides of the bottom of the weight assembly 1750 to the frame 1610. When everything is at rest, the bar 1743 occupies the position shown in FIG. 50 relative to the weights 1751, and the rod 1783 is movable through the keyway and into the engagement with the weights 1751.

The weights 1751 are disposed in a box 1757 which is shown in greater detail in FIG. 56. The box 1757 has opposing sidewalls 1753, which may be described as inwardly converging. The sidewalls 1753 form junctures with opposing base walls 1755, which may be described as more severely inwardly converging. Notches in the sidewalls 1753 are bounded by notch walls 1754 which may also be described as inwardly converging (though with respect to planes extending parallel to the drawing sheet for FIG. 56, as opposed to a single plane extending perpendicular thereto). The sidewalls 1753, the notch walls 1754, and the base walls 1755 are configured to guide the weights 1751 back into their proper positions or slots 1756 within the box 1757.

The box 1757 is movably mounted within a housing 1759 and is supported from below by shock absorbing springs 1758. The springs 1758 are disposed between the bottom wall of the box 1757 and the bottom wall of the housing 1759. The springs 1758 bias the box 1757 upward against pegs which project inward from the end walls of the box 1757. The shock absorbing springs 1658 are provided to accommodate downward impact which might occur at the conclusion of an exercise stroke.

Those skilled in the art will recognize that the assembly 1750 holds the weights 1751 in place prior to selection; keeps the weights 1751 spaced apart to ensure proper selection; supports the weights 1751 during exercise motion; and returns the weights 1751 to their proper location at the conclusion of exercise motion. Additional advantages of this embodiment 1750 include the elimination of guides extending along the weights' path of travel, and the ability to use a relatively smaller diameter selector rod (in combination with the bar).

On the other side of the apparatus 1700, a bar 1744 is rigidly secured to the base member 1741 and spans the weight assembly 1770.

Figure 52:
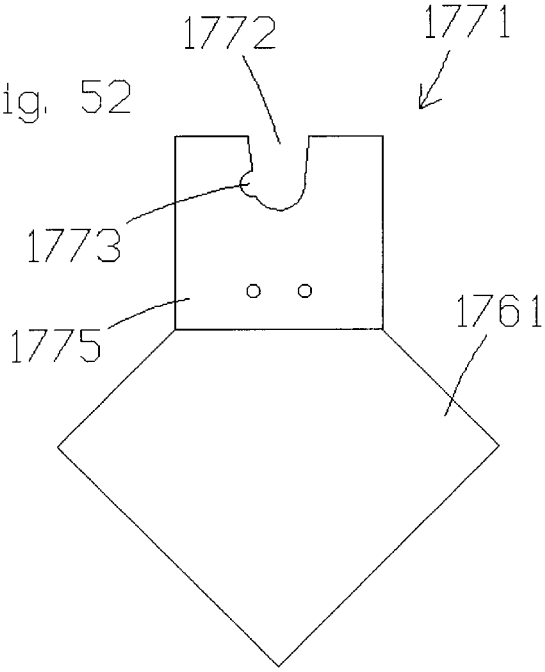
FIG. 52 is an end view of another part of the second supplemental weight assembly on the weight stack of FIG. 46.
Figure 53:
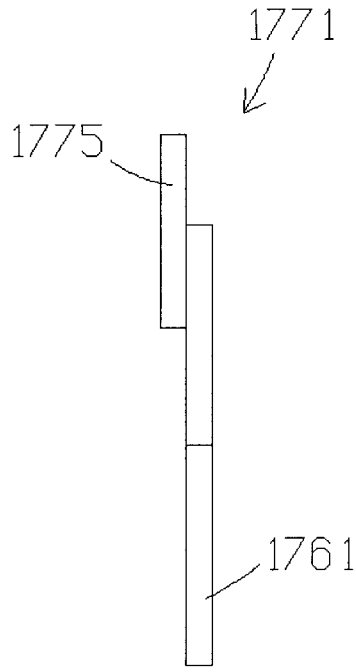
FIG. 53 is a more detailed front view of the part of FIG. 52.

As shown in FIG. 51, the bar 1744 includes a solid steel shaft 1763 inserted into a plastic sleeve 1764. A groove (not shown) extends the length of the bar 1744, and relatively large diameter rings 1769 project radially outward from the sleeve 1764. The profile of the groove has a radius of curvature comparable to that of the rod 1784. As shown in FIG. 52, each weight 1771 includes a relatively high mass member 1761 secured to a guide member 1775 by screws or other fasteners. An upwardly opening slot 1772 is formed in each guide member 1775 to accommodate the bar 1744. The rings 1769 on the bar 1744 insert between the guide members 1775 to maintain proper spacing between the weights 1771. A notch 1773 is formed in each guide member 1775 proximate the lower end of the slot 1772. The notch 1773 has a radius of curvature comparable to that of the groove and cooperates therewith to define a keyway sized and configured to receive the rod 1784 (in a manner similar to that shown in FIG. 50).

The supplemental weight assembly 1770 is mounted on the frame 1610 to the left of the base member 1741 (as shown in FIG. 46). Brackets 1615 rigidly connect the opposite sides of the bottom of the weight assembly 1770 to the frame 1610. When everything is at rest, the bar 1744 occupies the bottom portion of each slot 1757, and the rod 1784 is movable through the resulting keyways and into the engagement with the weights 1771. The assembly also includes a housing 1759' which is functionally similar to that on the assembly 1750.

Those skilled in the art will recognize that the assembly 1770 holds the weights 1771 in place prior to selection; keeps the weights 1771 spaced apart to ensure proper selection; supports the weights 1771 during exercise motion; and returns the weights 1771 to their proper location at the conclusion of exercise motion; and further, requires a relatively smaller diameter selector rod (in combination with the bar), and does not require guides extending along the weights'path of travel. Moreover, the assembly 1770 uses injection molded parts to eliminate milling procedures which might otherwise be required during manufacture.

Figure 54:
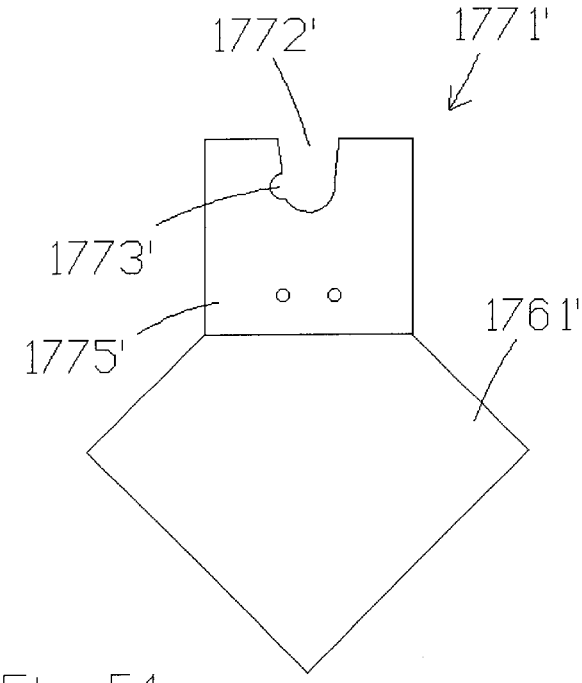
FIG. 54 is an end view of a suitable alternative for the part of FIG. 52.
Figure 55:
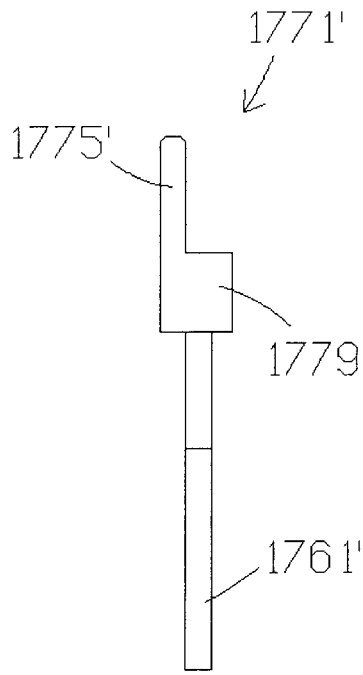
FIG. 55 is a front view of the part of FIG. 54.

An alternative weight 1771', which is suitable for use in the assembly 1770, is shown in FIGS. 54–55. Like the previous weight 1771, the weight 1771' includes a relatively high mass member 1761 connected to a guide member 1775' by screws or other suitable means. Like the previous guide member 1775, the guide member 1775' includes a slot 1772' to accommodate the bar 1744 and a notch 1773' to accommodate the rod 1784. However, the guide member 1775' provides a shoulder or spacer 1779 on an opposite side of the high mass member 1761 and cooperates with counterparts on adjacent weights to establish the effective spacing of the weights 1771'.

An alternative bar and rod combination is designated as 1730 in FIGS. 57–58. The assembly 1730 includes a bar 1734 of the type which may be rigidly secured to the base member 1741 in place of the bar 1744, for example. Downwardly projecting tabs 1739 are secured to the bar 1734 at spaced locations along the longitudinal axis thereof. Holes are formed through the tabs 1739 to receive a rod 1733 of the type which may be movably mounted to the base member 1741 in place of the rod 1784, for example. Upwardly opening notches 1732 are formed in the rod 1733 at spaced locations along the longitudinal axis thereof.

Weights 1731, which are similar in overall shape to the weights 1751, are maintained at spaced intervals in a housing similar to that designated as 1759 in FIG. 46. A hole is formed through each weight 1731 to receive the selector rod 1733. Advantages of this particular arrangement of parts include that the weights 1731 are encouraged to rest within respective notches 1732 when engaged by the selector rod 1733, and that the bar 1734 contributes to the structural integrity of the rod 1733. Those skilled in the art will also recognize that this assembly 1730, as well as the others described herein, may include weights of other sizes and/or shapes.

Figure 59:
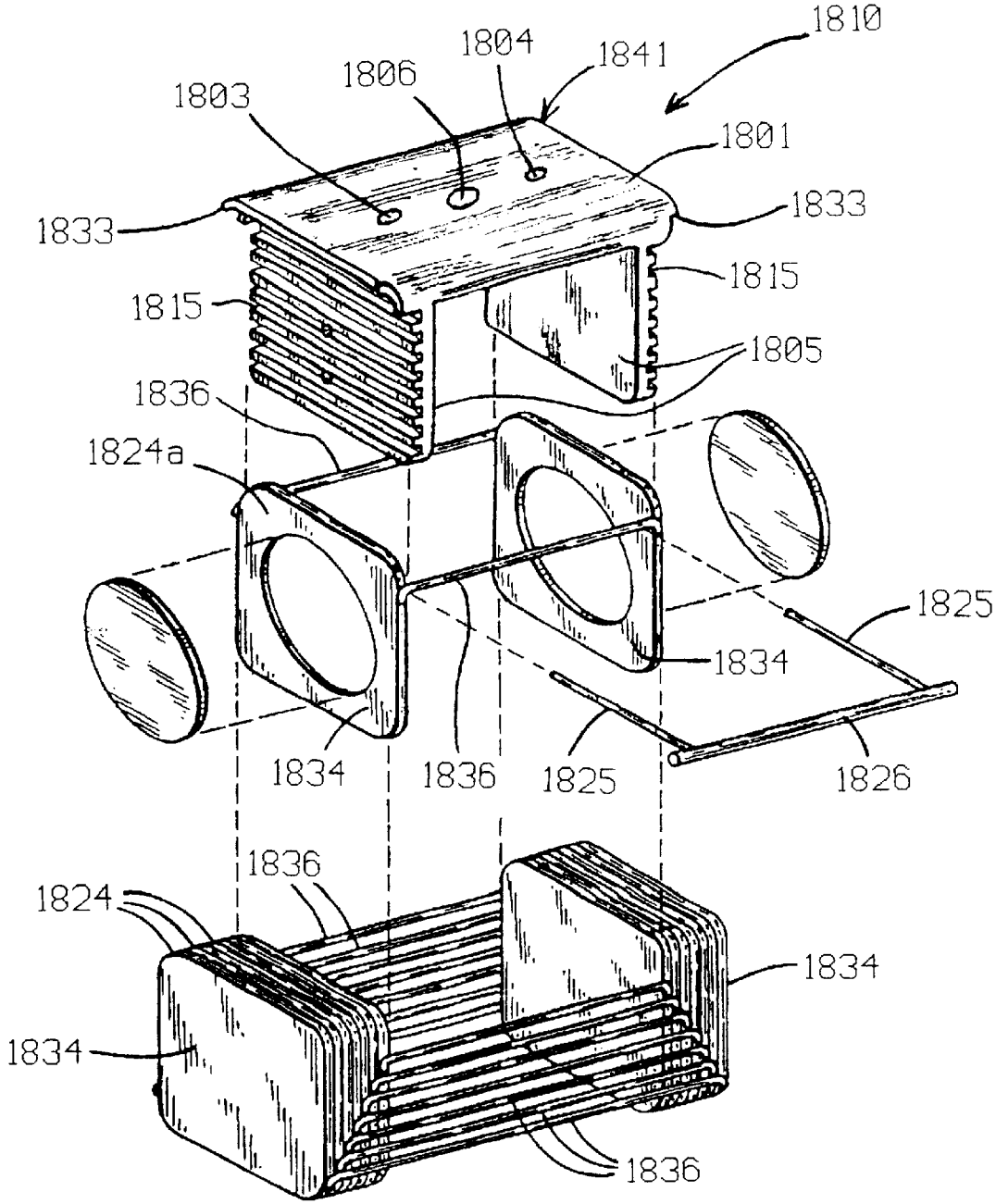
FIG. 59 is a perspective view of yet another supplemental weight assembly suitable for use on an exercise weight stack.

Yet another adjustable weight assembly is designated as 1810 in FIG. 59. This assembly 10 is similar in several respects to an adjustable dumbbell apparatus disclosed in U.S. Pat. No. 5,637,064 to Olson et al. (which is incorporated herein by reference). However, the assembly 1810 is distinguishable by the fact that the base member 1841 is configured to function as a top plate for a weight stack, as opposed to a handle for a dumbbell. In particular, the base member 1841 includes a block 1801 rigidly interconnected between opposite sidewalls 1805. The block 1801 and the sidewalls 1805 cooperate to define an inverted U-shaped configuration. Additional weight stack plates (not shown) are sized and configured to be disposed beneath the base member 1841 and between the sidewalls 1805.

Holes 1803 and 1804 are formed through the base member 1841 (and through the underlying weights) to accommodate respective guide rods in a manner known in the art. Another hole 1806 is formed through the base member 1841 (and through the underlying weights) to accommodate a selector rod which is operable to engage any number of weights beneath the base member 1841. The selector rod and/or base member 1841 are/is connected to a force receiving member by means of a cable.

As disclosed in the patent to Olson et al., the assembly 1810 further includes a plurality of nested weights 1824 which are selectively connected to the base member 1841 by means of a U-shaped selector pin 1826. In particular, grooves 1815 are formed in outwardly facing sides of the sidewalls 1805 to receive respective prongs 1825 of the pin 1826. As suggested by the projection lines in FIG. 59, the base member 1841 nests within the innermost weight **1824*a* which, in turn, nests within the remainder of the nested weights 1824**.

Each of the weights 1824 and **1824*a* includes a pair of end plates 1834 interconnected by a pair of side rails 1836. The side rails for any given weight are relatively shorter than the weights within which the given weight is nested, and relatively longer than the weights nested within the given weight. Also, the side rails for any given weight are relatively closer to the base member 1841 than those on the weights within which the given weight is nested, and relatively farther from the base member 1841** than those on the weights nested within the given weight.

Any available weight is selected by inserting the prongs 1825 of the selector pin 1826 beneath the "near" side rail 1836 of the weight, through aligned grooves 1815 on the base member 1841, and beneath the "far" side rail 1836. Lips 1833 project outwardly from the base member 1841 and overlie the upper edges of the innermost weight **1824*a*. The lips 1833 cooperate with the selector pin 1826 and the side rails 1836 to retain therebetween the "pinned" weight and any weights between the "pinned" weight and the base member 1841**.

Dumbbell Examples

Several of the improvements disclosed above may be implemented on free weight devices as well as weight stack machines. For example, a similar sort of adjustable or selectorized weight assembly, which may be used on a weight stack, is described with reference to a dumbbell designated as 1900 in FIGS. 60–67. The dumbbell 1900 generally includes a base member 1941, first and second selector rods 1920 and 1930 movably mounted on the base member 1941, and weights **1950*b*–1950*i* selectively engaged by selector rods 1920 and 1930**.

Figure 63:
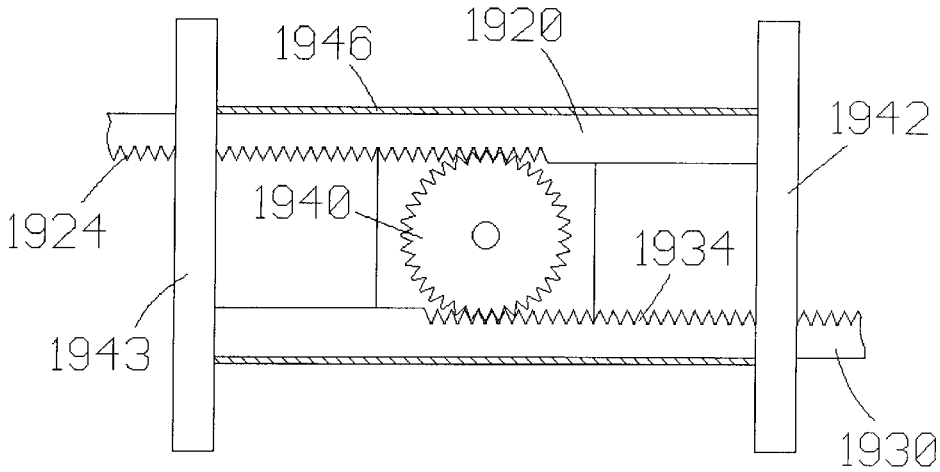
FIG. 63 is a partially sectioned, top view of part of the dumbbell of FIGS. 60–62.

The base member 1941 includes a handle 1945 sized and configured for grasping and rigidly interconnected between opposite side members 1942 and 1943. A panel 1946 is also rigidly interconnected between the side members 1942 and 1943. The selector rods 1920 and 1930 are movably connected to both the panel 1946 and the side members 1942 and 1943. As shown in FIG. 63, gear teeth 1924 are provided along a "rack" portion of the selector rod 1920, and gear teeth 1934 are provided along a "rack" portion of the selector rod 1930. A rotary gear 1940 is rotatably mounted on the panel 1946 and disposed between the rack portions of the selector rods 1920 and 1930. The gear or pinion 1940 constrains the selector rods 1920 and 1930 to move in opposite directions, through openings in the side members 1942 and 1943.

Each of the weights **1950*b*–1950*i* includes a first plate 1952, a second plate 1953, and a respective pair of equal length connector rods 1959*b*–1959*i* rigidly interconnected therebetween. The rods 1959*b* are relatively short, and the weight 1950*b* is disposed between the plates 1952 and 1953 on the other weights 1950*c*–1950*i*. The rods 1959*i* are relatively long, and the plates 1952 and 1953 on the weight 1950*i* are disposed outside the other weights 1950*b*–1950*h*. The rods 1959*c*–1959*h* and the plates 1952 and 1953 on the weights 1950*c*–1950*h*** fall in between these two extremes.

Figure 64:
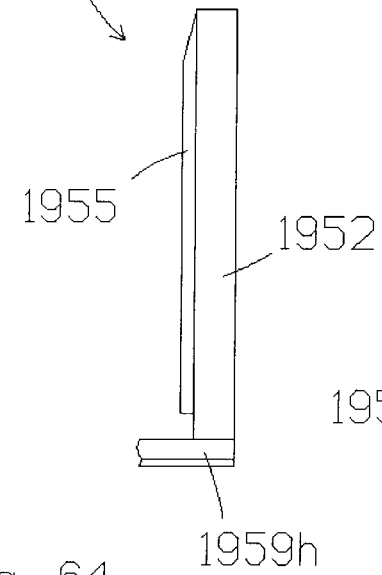
FIG. 64 is a front view of one end of a weight which is part of the dumbbell of FIGS. 60–62.
Figure 65:
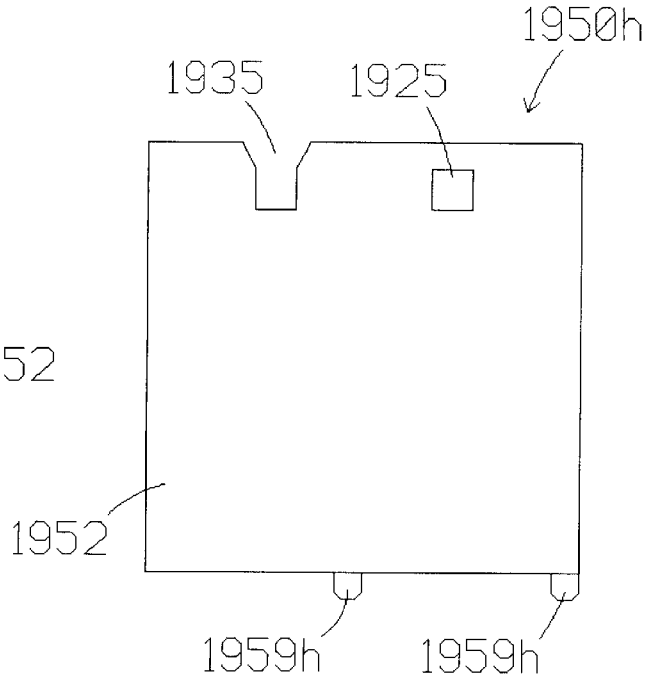
FIG. 65 is an end view of the weight end of FIG. 64.

A front view of one side of the weight 1950*h* is shown in FIG. 64. Each of the plates 1952 is a mirror image of each of the plates 1953. The connector rods 1959*h* and a spacer 1955 extend away from the plate 1952 shown in FIG. 64 and toward the "opposite side" plate 1953. The spacer 1955 maintains the plate 1952 on the weight 1959*h* at a desired distance from the plate 1952 on the weight 1959*g*. The spacer 1955 is upwardly tapered to guide the plate 1952 on the weight 1959*g* back into position relative to the plate 1952 on the weight 1959*h* when the former is selected and removed to the exclusion of the latter. As shown in FIG. 65, which is an end view of the weight portion shown in FIG. 64, the connector rods may be downwardly tapered to encourage their proper return relative to their counterparts on any "unselected" weights.

A hole 1925 extends through each of the plates 1952 to selectively receive the "opposite side" selector rod 1920. A similar hole extends through each of the plates 1953 to receive the "opposite side" selector rod 1930. A slot 1935 extends into each of the plates 1952 to accommodate the "same side" selector rod 1930 and allow it to clear the plate 1952 when the corresponding weight is not selected. A similar slot extends into each of the plates 1953 to accommodate the "same side" selector rod 1920 and allow it to clear the plate 1953 when the corresponding weight is not selected. The slots are bounded by downwardly converging sidewalls to encourage return of the base 1941 to its proper position relative to any "unselected" weights.

With reference back to FIG. 60, a knob 1947 is secured to the gear 1940 and rotatable together therewith relative to the panel 1946. Inwardly directed notches 1948 are provided about the circumference of the knob 1947, at angularly displaced locations aligned with indicia on the knob 1947. A spring loaded latch member 1949 is mounted on the panel 1946 and operable to selectively engage any of the notches 1948. The latch 1949 may include any known mechanism suitable for cooperating with the notches 1948 to bias the knob 1947 toward discrete orientations relative to the panel 1946. In other words, the knob 1947 is designed to "click" into discrete orientations like a channel selector knob on an early model television set.

Figure 66:
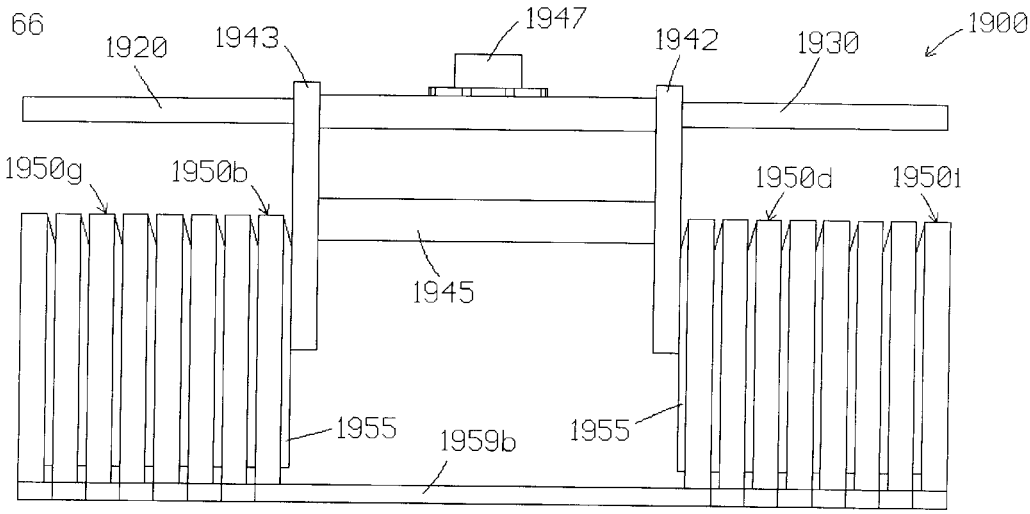
FIG. 66 is a front view of the dumbbell of FIGS. 60–62 with no supplemental weights selected.
Figure 67:
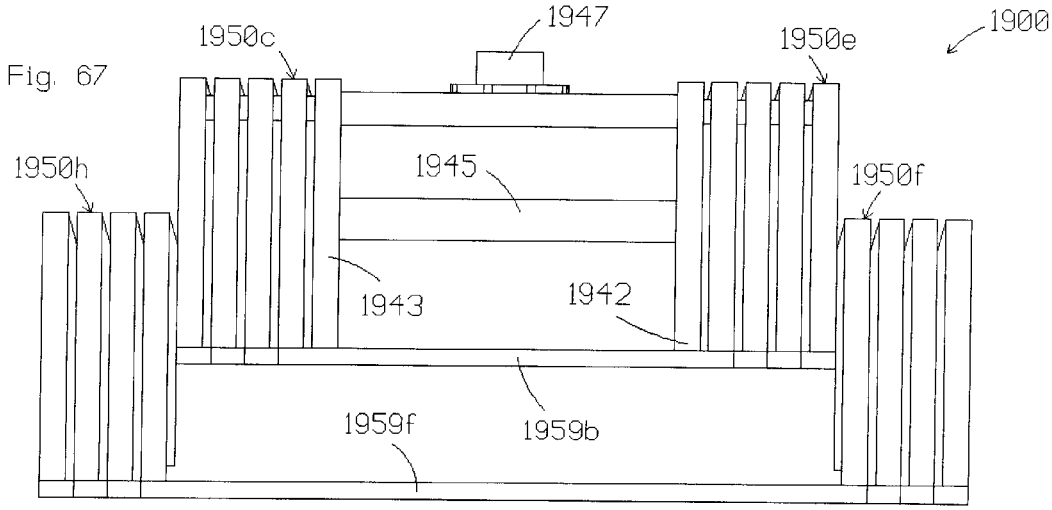
FIG. 67 is a front view of the dumbbell of FIGS. 60–62 with four supplemental weights selected.

The markings on the knob 1947 indicate how much weight is currently selected. Letters are used as indicia in FIG. 60 for ease of reference. When the notch associated with the "A" is engaged, as shown in FIG. 66, the leading ends of the selector rods 1920 and 1930 terminate in respective side members 1942 and 1943. In this configuration, none of the weights 1950*b*–1950*i* is selected, and the base 1941 alone is movable for exercise purposes. When the notch associated with the "E" is engaged, as shown in FIG. 67, the leading ends of the selector rods 1920 and 1930 terminate in respective plates 1952 and 1953 on the weight 1950*e*. In this configuration, the weights 1950*b*–1950*e* are selected and movable together with the base 1941 for exercise purposes.

An advantage of this embodiment 1900 is that the assembly is self-aligning and thus, does not require a dedicated housing to keep the individual weights properly positioned. Also worth noting is that the foregoing arrangement may be modified to reduce the size of the selector rods and/or provide additional support for the weights. For example, the holes in the plates may be replaced by grooves to facilitate keyway arrangements similar to those discussed above with reference to FIGS. 46–55.

Another selectorized weight assembly is shown in "dumbbell format" in FIGS. 68–75. The dumbbell assembly 2000 generally includes a base member 2041, first and second selector rods 2020 and 2030 movably mounted on the base member 2041, weights 2050 and 2060 selectively engaged by respective selector rods 2030 and 2020, and a stand 2080 to support the other components when not in use.

The base member 2041 includes a handle 2045 sized and configured for grasping and rigidly interconnected between opposite side members 2042 and 2043. The first selector rod 2020 has parallel prongs 2021 which are interconnected at one end by a generally U-shaped handle 2022 that extends perpendicularly away from the prongs 2021. Similarly, the second selector rod 2030 has parallel prongs 2031 which are interconnected at one end by a generally U-shaped handle 2032 that extends perpendicularly away from the prongs 2031. The prongs 2621 and 2031 are movably connected to the side members 2042 and 2043.

Gear teeth are provided along a "rack" portion of each of the prongs 2021 and 2031. As shown in FIG. 75, a rotary gear 2040 is rotatably mounted on the side member 2042 and disposed between the rack portions of adjacent prongs 2021 and 2031. The gear or pinion 2040 constrains the selector rods 2020 and 2030 to move in opposite directions, through openings in the side members 2042 and 2043. Each revolution of the gear 2040 moves each of the selector rods 2020 or 2030 into or out of engagement with a single weight 2060 or 2050, respectively. A biasing means 2049 cooperates with the other set of adjacent prongs 2021 and 2031 to bias the selector rods 2020 and 2030 in place subsequent to each revolution of the gear 2040.

Figure 72:
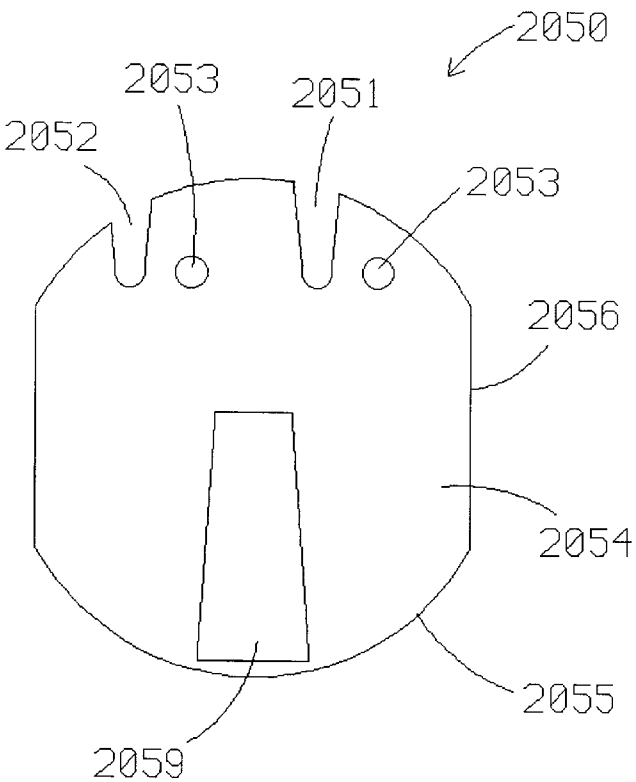
FIG. 72 is an opposite end view of the weight of FIG. 70.
Figure 71:
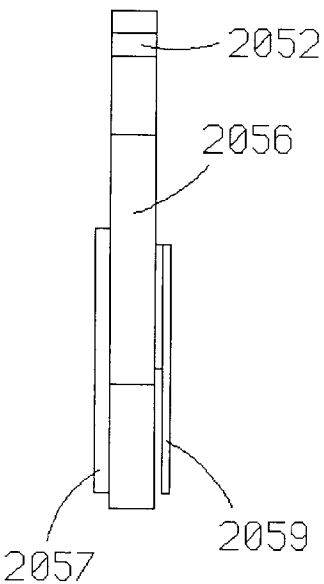
FIG. 71 is a front view of the weight of FIG. 70.
Figure 70:
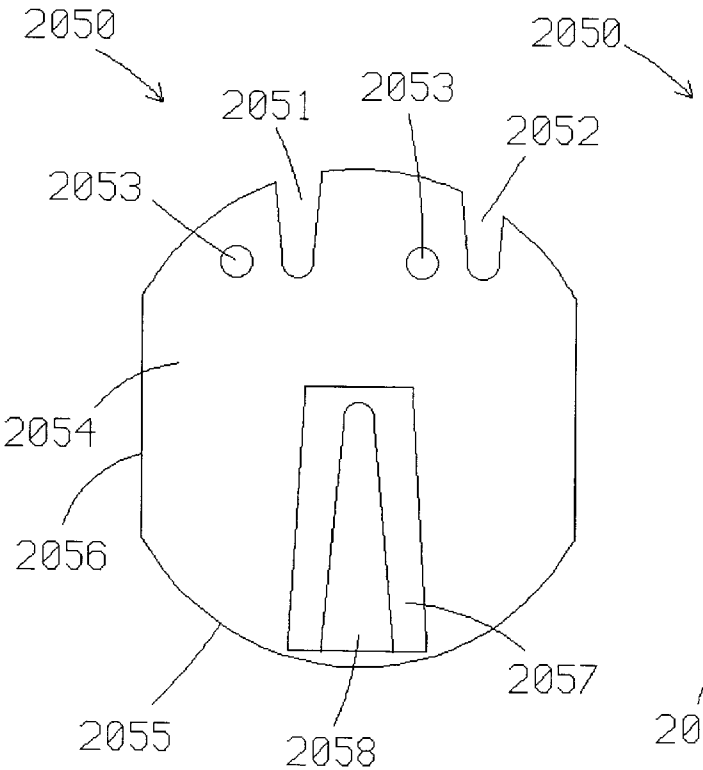
FIG. 70 is an end view of a weight which is part of the dumbbell of FIGS. 68–69.

One of the weights 2050 is shown in greater detail in FIGS. 70–72. The weights 2060 are mirror images of the weights 2050. The weight 2050 may be described as a generally oval plate 2054 having rounded upper and lower edges 2055 and straight side edges 2056. Holes 2053 extend through the plate 2054 to selectively receive the prongs 2031 of the "opposite side" selector rod 2030. Similar holes extend through each of the weights 2060 to receive the prongs 2021 of the "opposite side" selector rod 2020. Slots 2051 and 2052 extend into the plates 2054 to accommodate the "same side" selector rod 2020 and allow it to clear the plate 2054 when the weight 2050 is not selected. Similar slots extend into each of the weights 2060 to accommodate the "same side" selector rod 2030 and allow it to clear same when they are not selected. The slots are bounded by downwardly converging sidewalls to encourage return of the base 2041 to its proper position relative to any "unselected" weights. The weights 2060 and 2050 are selected simply by moving the two selector rods 2020 and 2030 relative to one another and into or out of the holes in the "opposite side" weights.

Members 2057 and 2059 are mounted to opposite sides of the plate 2054 to maintain proper spacing between the weights 2050, and also, to interconnect the weights 2050 in a manner which discourages relative movement in a direction parallel to the handle 2045 but does not interfere with upward movement of an inside weight relative to an adjacent outside weight. Each member 2057 projects away from the handle 2045 and provides a downwardly opening slot 2058. Each member 2059 projects toward the handle 2045 and provides a T-shaped rail sized and configured to slide into the slot 2058 on an adjacent weight. A similar member 2057 is also mounted on the outwardly facing side of each side member 2042 or 2043 to receive the T-shaped rail on the "inwardmost" weight.

A stand or support 2080 for the assembly 2000 is shown in FIGS. 73–74. The support 2080 includes a flat base 2081 and a pair of boxes 2082 and 2083 extending upward therefrom to support the weights 2050 and 2060 respectively. The upper portion of each box 2082 and 2083 has downwardly convergent sidewalls 2088 which encourage respective weights 2050 and 2060 into alignment with respective boxes 2082 and 2083. The lower portion of each box 2082 and 2083 has straight sidewalls 2086 and a curved bottom wall 2085 which are sized and configured to maintain the respective weights 2050 and 2060 in a stable position. Slots 2084 extend into the inwardly facing sidewalls of the two boxes 2082 and 2083 to accommodate the handle 2045. The walls 2089 of each slot 2084 are downwardly convergent to encourage the handle 2045 into alignment with the support 2080.

Advantages of the embodiment 2000 include that the handle 2040 is relatively more accessible, and that relative few assembly steps are required to manufacture the dumbbell 2000. Given the relatively complicated configuration of the weights 2050 and 2060, it may be desirable to injection mold the exterior of the weights 2050 and 2060 and disposed a relatively heavier material in the interior thereof.

Yet another weight assembly is shown in "dumbbell format" in FIGS. 76–80. The dumbbell assembly 2100 is similar in several respects to the previous embodiment 2000. For example, the assembly 2100 similarly includes a base member 2141, first and second selector rods 2120 and 2130 movably mounted on the base member 2141, weights 2150 and 2160 selectively engaged by respective selector rods 2130 and 2120, and a stand (not shown) to support the aforementioned components when not in use. The assembly 2100 also shares some common features with the weight assembly 1770 shown in FIG. 46. For example, the assembly 2100 similarly has spacers 2170 and 2180 secured to opposite sides of a handle 2145 at fixed intervals along the longitudinal axis thereof, and the stand for the assembly 2100 similarly requires a separate slot for each of the weights 2150 and 2160.

The handle 2145 is sized and configured for grasping and is rigidly interconnected between opposite side members 2142 and 2143. The first selector rod 2120 has parallel prongs 2121 which are interconnected at one end by a generally U-shaped handle 2122 that extends perpendicularly away from the prongs 2121. Similarly, the second selector rod 2130 has parallel prongs 2131 which are interconnected at one end by a generally U-shaped handle 2132 that extends perpendicularly away from the prongs 2131. The prongs 2121 and 2131 are inserted through holes in (and thereby movably connected to) the side members 2142 and 2143.

Figure 78:
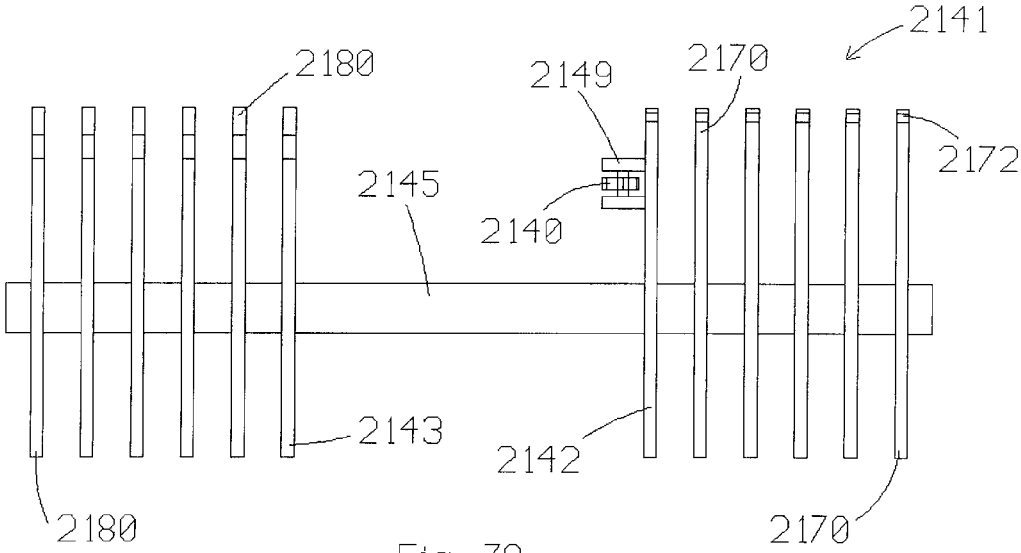
FIG. 78 is a front view of a base member which is part of the dumbbell of FIGS. 76–77.

Gear teeth are provided along a "rack" portion of each of the prongs 2121 and 2131. As shown in FIG. 78, a rotary gear 2140 is rotatably mounted on the side member 2142 and interconnected between the rack portions of adjacent prongs 2121 and 2131. The gear or pinion 2140 constrains the selector rods 2120 and 2130 to move in opposite directions, through the holes in the side members 2142 and 2143. Each revolution of the gear 2040 moves each of the selector rods 2120 or 2130 into or out of engagement with a single weight 2160 or 2150, respectively. A biasing means 2149 biases the selector rods 2120 and 2130 in place subsequent to each revolution of the gear 2140.

Figure 79:
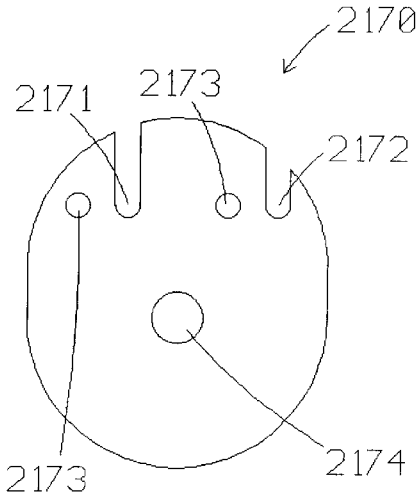
FIG. 79 is an end view of a spacer which is part of the base member of FIG. 78.

One of the spacers 2170 is shown in greater detail in FIG. 79. The spacers 2180 are mirror images of the spacers 2170. The spacer 2170 may be described as a generally oval plate having rounded upper and lower edges and straight side edges. A hole 2174 extends through the spacer 2170 to receive the handle 2145. The spacers 2170 and 2180 (as well as the side members 2142 and 2143) may be secured to the handle 2145 in various manners known in the art, including integral molding, in which case a reinforcing shaft may be inserted lengthwise through the handle 2145. Holes 2173 extend through the spacer 2170 to selectively receive the prongs 2131 of the "opposite side" selector rod 2130. Similar holes extend through each of the spacers 2180 to receive the prongs 2121 of the "opposite side" selector rod 2120. Slots 2171 and 2172 extend into the spacers 2170 to accommodate the "same side" selector rod 2120 and allow it to clear the spacer 2170 when "outboard" weights are not selected. Similar slots extend into the spacers 2180 to accommodate the "same side" selector rod 2130 and allow it to clear same when corresponding "outboard" weights are not selected.

Figure 80:
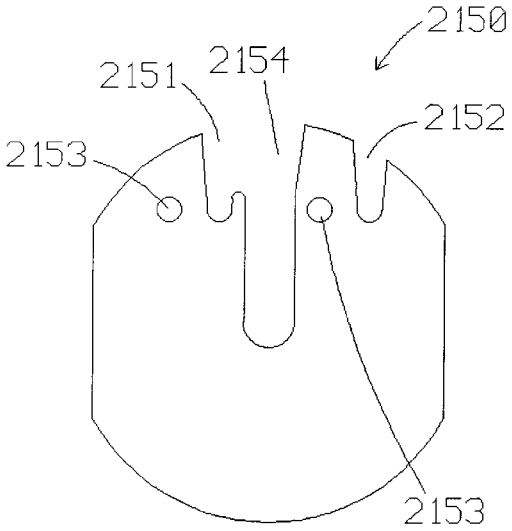
FIG. 80 is an end view of a weight which is part of the dumbbell of FIGS. 76–77.

One of the weights 2150 is shown in greater detail in FIG. 80. The weights 2160 are mirror images of the weights 2150. The weight 2150 may be described as a generally oval plate having rounded upper and lower edges and straight side edges. A relatively large slot 2154 extends into the weight 2150 to accommodate the handle 2145. Holes 2153 extend through the weight 2150 to selectively receive the prongs 2131 of the "opposite side" selector rod 2130. Similar holes extend through each of the weights 2160 to receive the prongs 2121 of the "opposite side" selector rod 2120. Relatively smaller slots 2151 and 2152 extend into the weight 2150 to accommodate the "same side" selector rod 2120 and allow it to clear the weight 2150 when it is not selected. Similar slots extend into each of the weights 2160 to accommodate the "same side" selector rod 2130 and allow it to clear same when it is not selected.

The slots are bounded by downwardly converging sidewalls to encourage return of the base 2141 to its proper position relative to any "unselected" weights. The weights are selected by moving the two selector rods 2120 and 2130 relative to one another and into or out of the holes in the "opposite side" weights. Any "unselected" weights remain in place on a stand or other support when the base 2141 is lifted away from the stand. It may be desirable to bevel leading edges to encourage proper insertion of parts which move relative to one another. For example, a lower distal portion of each spacer 2170 and 2180 may be made relatively thinner, and an upper distal portion of each weight 2150 and 2160 may be made relatively thinner, in order to provide a more forgiving tolerance as the former are lowered into adjacent and alternating positions relative to the latter.

Figure 81:
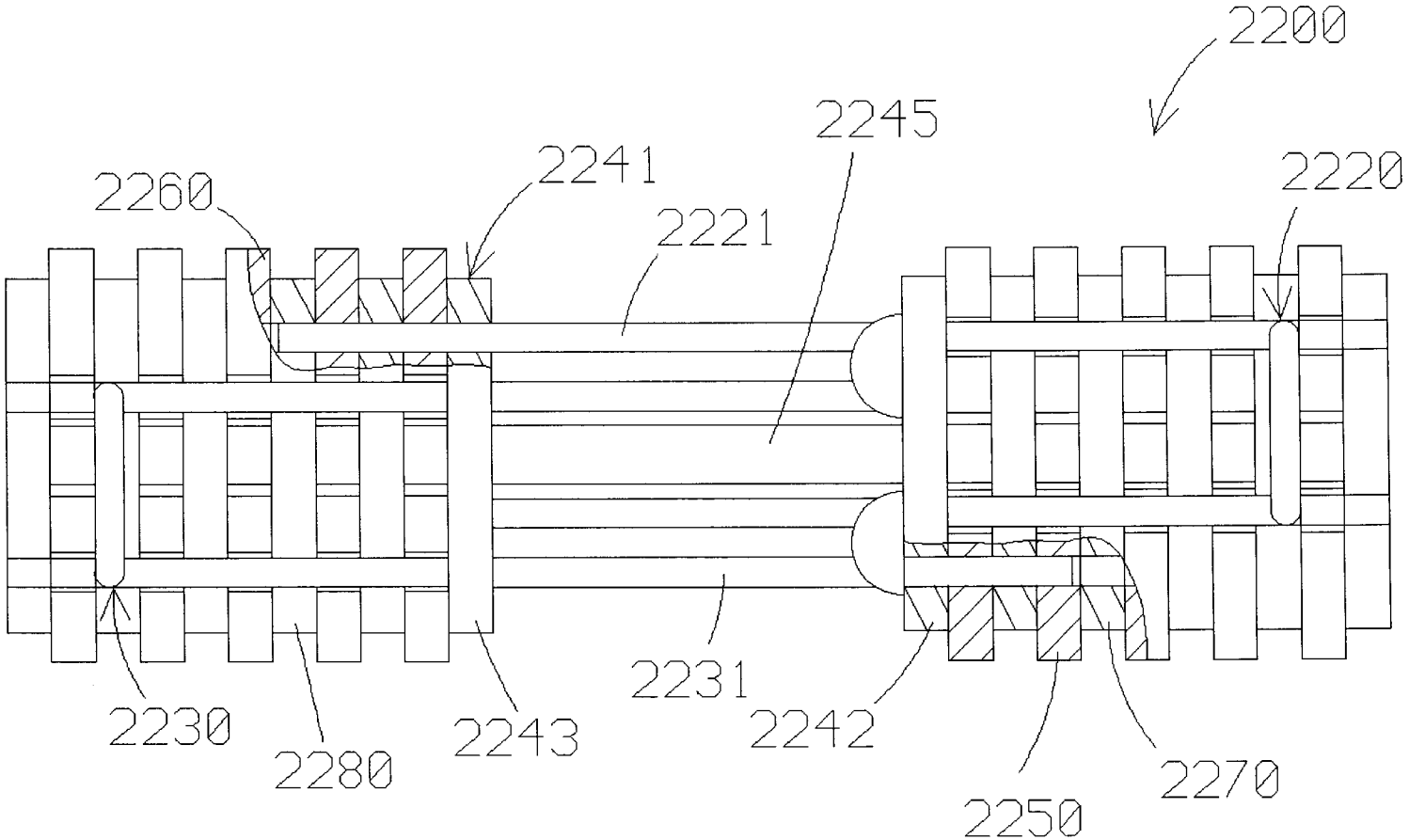
FIG. 81 is a partially sectioned, top view of still another dumbbell constructed according to the principles of the present invention.

Another design consideration is the width of the spacers disposed between the weights. For example, as shown in FIG. 81, a dumbbell similar to the assembly 2100 has relatively wider spacers 2270 disposed between weights 2250, and relatively wider spacers 2280 disposed between weights 2260. The relatively wider spacers 2270 and 2280 (and side members 2242 and 2243) provide a greater margin for error with regard to the positions of prongs 2221 and 2231 on respective selector rods 2220 and 2230. In this case, the width of the spacers 2270 and 2280 is sufficient to allow the selector rods 2220 and 2230 to be out of phase, so to speak. In particular, each revolution of the pinion gear (not shown) causes only one of the selector rods 2220 or 2230 to engage an additional weight 2260 or 2250, while the other selector rod moves into engagement with the next spacer 2280 or 2270. For example, the assembly 2200 is shown in FIG. 81 to have engaged two weights on each side of the base 2241. One more turn of the pinion gear will cause the selector rod 2220 to engage a third weight 2260, and the selector rod 2230 to engage a second spacer 2270. Such an arrangement allows twice as many weight adjustments, or in other words, weight adjustments in increments one-half as great, for a given number of weights on the assembly 2200.

Yet another design consideration is the configuration of the weights on any particular assembly. For example, those skilled in the art may recognize the desirability of making the an upper half or a lower half of the weights a different size, and/or locating the handle slightly off center relative to the weights, in order to compensate for the weight of the selector rods and/or the portions removed from the upper portions of the weights. Those skilled in the art will also recognize that these two eccentricities may be engineered to more or less balance each other. The spacers 2170 and 2180 are shown "offset" for purposes of illustration, recognizing that the weight of the spacers may render this "offset" insignificant in the embodiment shown.

Selection of Weights Beneath a Base Member

A "rotating selector rod" embodiment of the present invention is described with reference to FIGS. 1–18. Again, those skilled in the art will recognize that this embodiment is useful by itself and/or together with various "side-loaded" assemblies described above.

Figure 1:
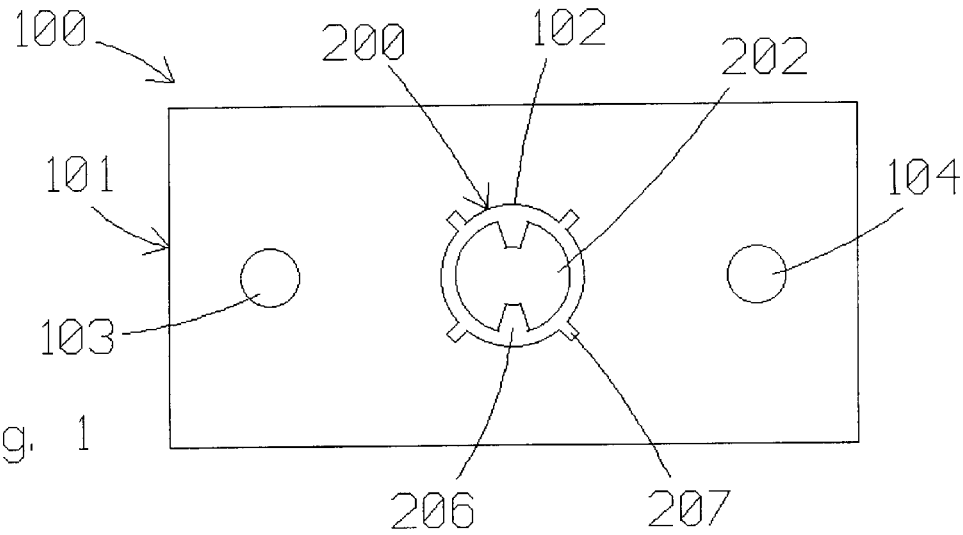
FIG. 1 is a top view of a weight stack plate and insert constructed according to the principles of the present invention.

A weight stack plate constructed according to the principles of the present invention is designated as 100 in FIG. 1. The weight stack plate 100 includes a weight 101 and an attachment or insert 200.

Figure 2:
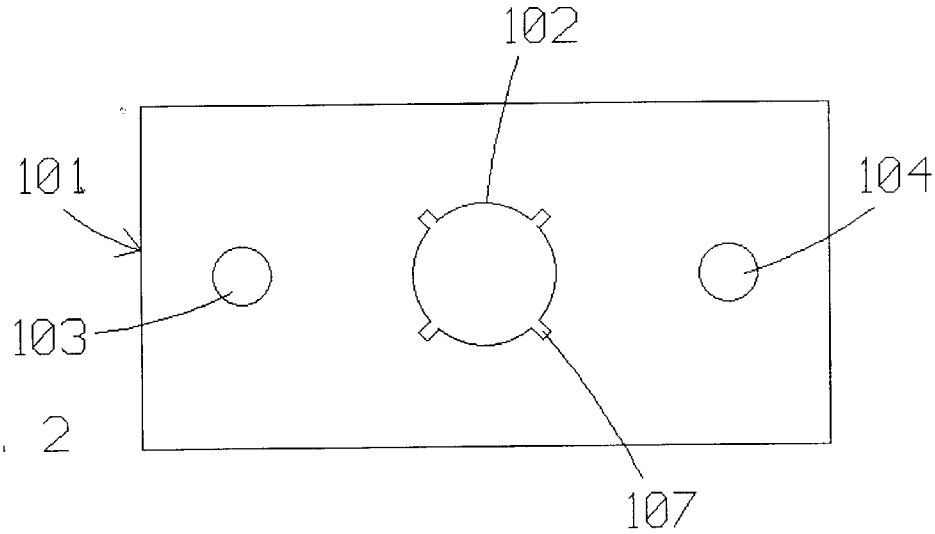
FIG. 2 is a top view of the weight stack plate of FIG. 1, the insert having been removed.
Figure 3:
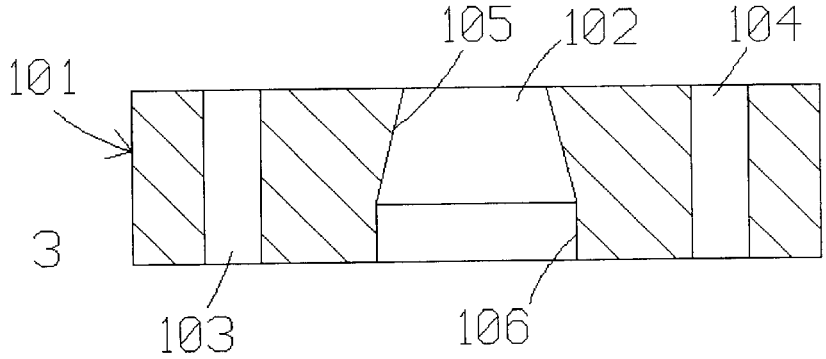
FIG. 3 is a sectioned side view of the weight stack plate of FIG. 2.

The weight 101 is shown by itself in FIGS. 2–3. The weight 101 is generally rectangular in shape and is made from a relatively heavy and durable material, such as steel. Circular holes 103 and 104 are formed through the weight 101, proximate opposite ends thereof, to receive guide rods (designated as 713 and 714 in FIG. 17) in a manner known in the art. Those skilled in the art will recognize that guide rods are commonplace on most weight stacks, but also, that the present invention is not limited to such an arrangement. For example, a viable alternative to guide rods is disclosed in U.S. Pat. No. 5,374,229 to Sencil, which is incorporated herein by reference to same.

Figure 13:
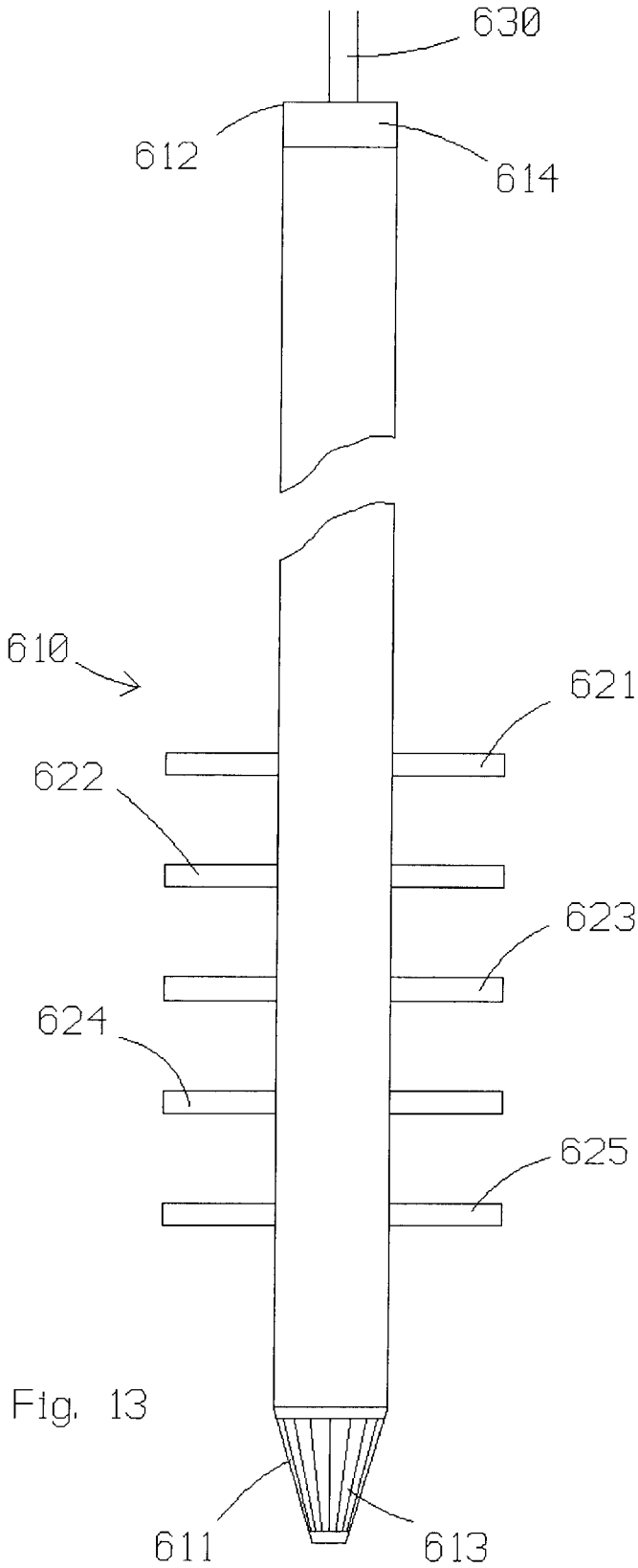
FIG. 13 is a fragmented front view of a selector rod constructed according to the principles of the present invention and suitable for use together with the weight stack of FIG. 12.

A relatively larger opening 102 is formed through the center of the weight 101 to receive the insert 200 and accommodate a selector rod (designated as 600 in FIG. 13). The central opening 102 is generally circular but includes radially extending slots 107 which are circumferentially spaced about the opening 102. As shown in FIG. 3, the opening 102 is formed in part by a conical sidewall 105 which diverges away from the top of the weight 101, and in part by a cylindrical sidewall 106 which meets the conical sidewall 105 within the weight 101 and continues through to the bottom of the weight 101.

Figure 4:
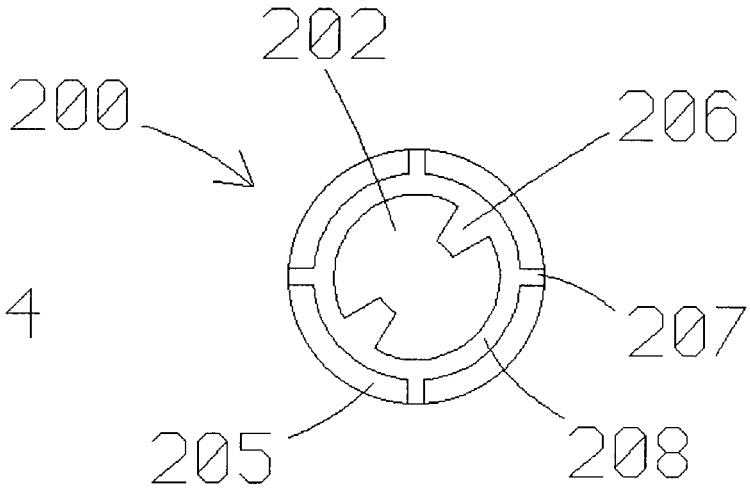
FIG. 4 is a top view of the insert of FIG. 1.
Figure 5:
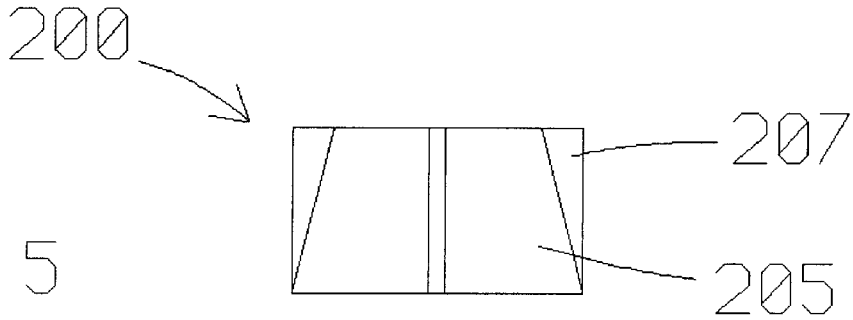
FIG. 5 is a side view of the insert of FIG. 1.
Figure 6:
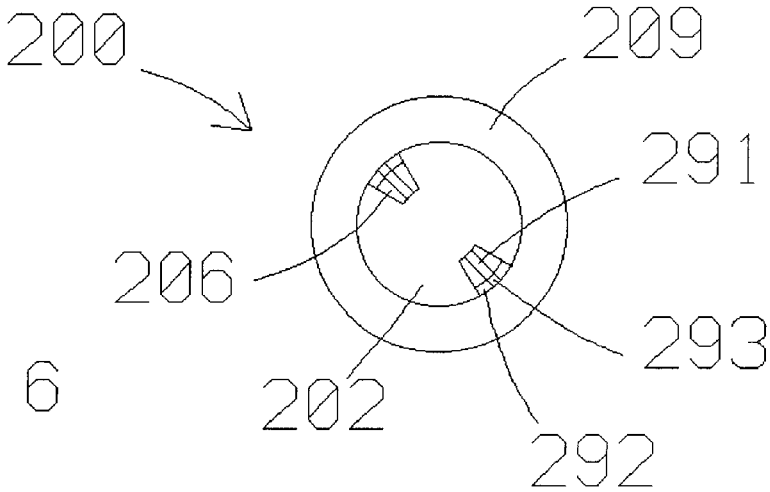
FIG. 6 is a bottom view of the insert of FIG. 1.

The insert 200 is shown by itself in FIGS. 4–6. The insert 200 is generally conical in shape and is made from a relatively durable and conveniently molded material, such as plastic. The insert 205 has a conical sidewall 205 which is sized and configured to concentrically nest within the conical sidewall 105 of the weight 101. The sidewall 205 extends between a top surface 208 and a bottom surface 209. The sidewall 205 bounds a central opening 202 which extends through the insert 200. Diametrically opposed tabs 206 extend radially inward from the sidewall 205 and cooperate with the sidewall 205 to define a keyway (for reasons discussed below).

Fins 207 extend radially outward from the sidewall 205 and are sized and configured to nest within the slots 107 in the weight 101. The fins 207 and the slots 107 cooperate to align the insert 200 relative to the weight 101 and to prevent rotation of the former relative to the latter. Those skilled in the art will recognize that the orientation of each insert is significant, but also, that the present invention is not limited to this particular manner of construction. For example, some additional insert attachment methods are disclosed in U.S. Pat. No. 4,601,466 to Lais, which is incorporated herein by reference to same.

Figure 7:
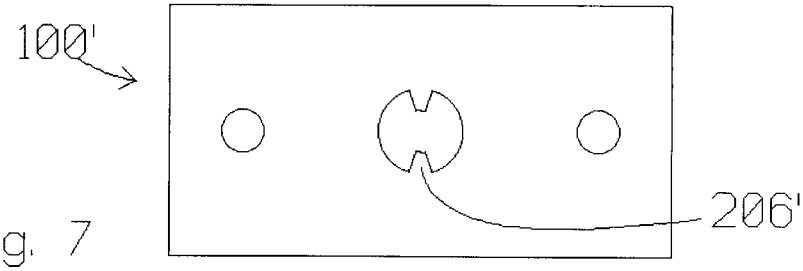
FIG. 7 is a top view of an integrally formed weight stack weight which is identical in size and configuration to the weight stack plate and insert of FIG. 1.

A set of weight stack plates is shown in FIGS. 7–11. The weight stack plate 100' in FIG. 7 is similar to that shown in FIG. 1, except that the keyway is formed in the plate itself, rather than by securing an insert to the plate 100'. The inclusion of FIG. 7 is intended to emphasize that the present invention is not limited to either a specific combination of parts or a particular method of construction.

Figure 8:
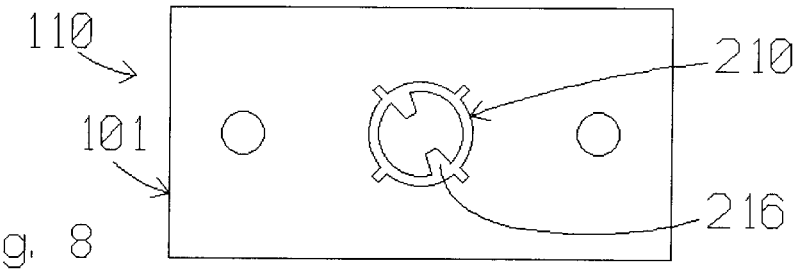
FIG. 8 is a top view of the weight stack plate of FIG. 2 and a second discrete insert.
Figure 9:
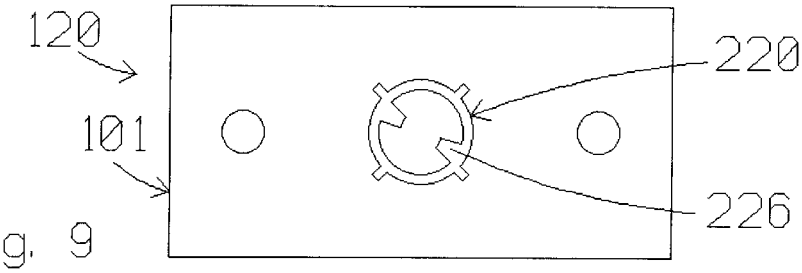
FIG. 9 is a top view of the weight stack plate of FIG. 2 and a third discrete insert.
Figure 10:
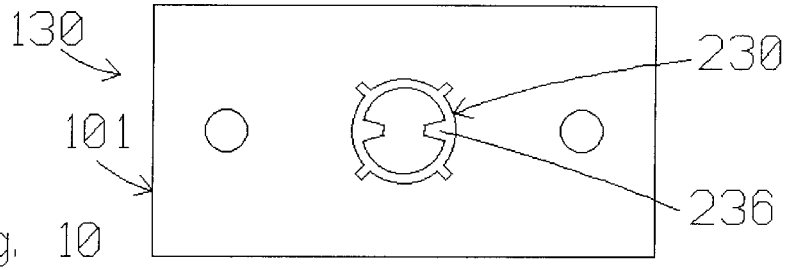
FIG. 10 is a top view of the weight stack plate of FIG. 2 and an insert similar to that of FIG. 1 but oriented differently.
Figure 11:
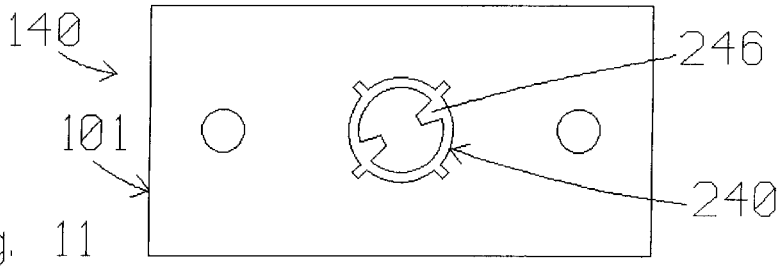
FIG. 11 is a top view of the weight stack plate of FIG. 2 and an insert similar to that of FIG. 8 but oriented differently.
Figure 12:
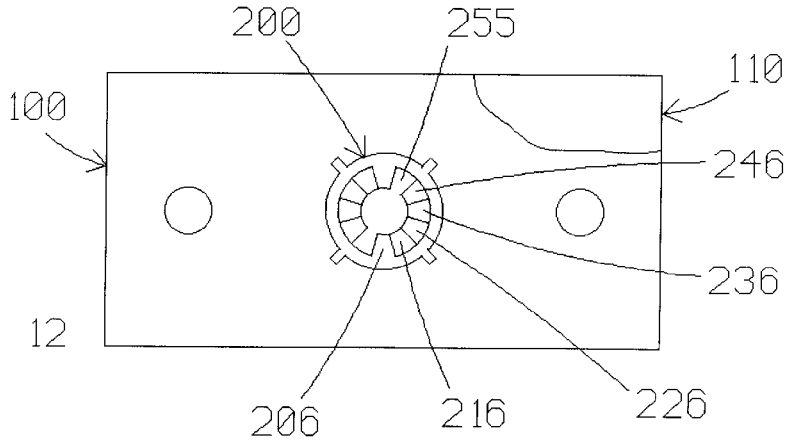
FIG. 12 is a top view of a weight stack comprising the weight stack plates and inserts of FIGS. 1 and 8–11, the plates having been stacked one on top of the other.
Figure 14:
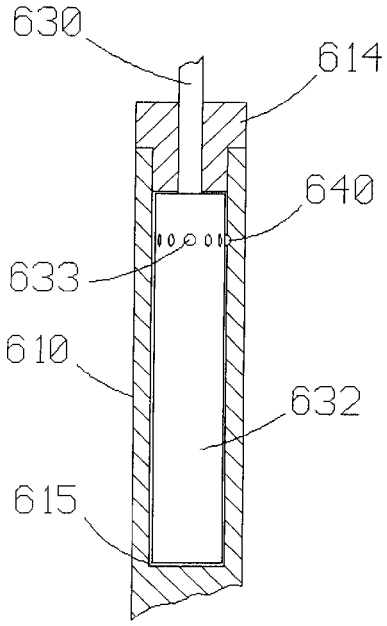
FIG. 14 is a sectioned front view of an upper portion of the selector rod of FIG. 13.

A second weight stack plate 110 is shown in FIG. 8. The weight stack plate 110 includes an identical weight 101 and a distinct insert 210. In particular, the insert 210 has structural features similar to those of the insert 200, except for the relative orientations of the tabs 216 and the fins 207 (and the orientation of the resulting keyway). In other words, the tabs 216 and the tabs 206 (or 206') occupy discrete sectors when the plate 110 is aligned with and stacked beneath the plate 100 (or 100'). The same may be said for each of the weight stack plates 120, 130, and 140 shown in FIGS. 9, 10, and 11, respectively. Thus, when the weight stack plates 100, 110, 120, 130, and 140 are stacked one above the other, as shown in FIG. 12, the tabs 206, 216, 226, 236, and 246 on the weight plates are disposed at discrete orientations (and within discrete sectors) relative to one another, and they leave diametrically opposed openings 255 unobstructed along the height of the stack.

A selector rod 610 and portions thereof are shown in FIGS. 13–16. The rod 610 extends between a first, lower end 611 and a second, upper end 612. Gear teeth 613 are disposed on the lower end 611 to provide a means for rotating the rod 610. A cap 614 is threaded onto the upper end 612 of the rod 610 and effectively seals off a compartment 615. A shaft 632 is disposed within the compartment 615 and connected to an end of a flexible cable or connector 630. As is known in the art, an opposite end of the cable 630 is connected to a force receiving member which may be acted upon subject to resistance from the weight of the selector rod 610 and any weight stack plates engaged thereby. Those skilled in the art will recognize that the present invention is not limited to any particular type or number of force receiving members or any particular method of connecting the force receiving member(s) to the selector rod or top plate in the weight stack. A few of the numerous possibilities are disclosed in U.S. Pat. No. 3,912,261 to Lambert, Sr.; U.S. Pat. No. 5,263,915 to Habing; U.S. Pat. No. 4,900,018 to Ish III, et al.; and U.S. Pat. No. 4,878,663 to Luquette, which patents are incorporated herein by reference to same.

Depressions 633 are formed in the shaft 632 proximate the upper end thereof to selectively receive a ball detent 640 mounted on the sidewall of the compartment 615. As a result of this arrangement, the rod 610 is rotatable relative to the shaft 632 and the cable 630, and the ball detent 640 and holes 633 cooperate to bias the rod 610 toward discrete orientations (or sectors) relative to the shaft 632 and the cable 630. These discrete orientations of the holes 633 coincide with the orientations of the tabs 206, 216, 226, 236, and 246 on the respective weight stack plates 100, 110, 120, 130, and 140.

Figure 15:
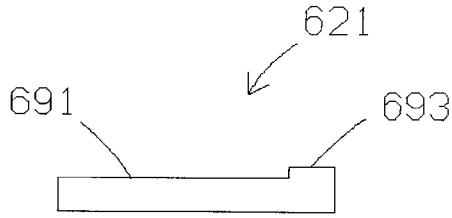
FIG. 15 is an enlarged front view of a catch on the selector rod of FIG. 13.

Selector pins 621–625 extend radially outward from opposite sides of the rod 610. Each of the pins 621–625 is disposed immediately beneath, and within the cylindrical wall 106 of, a respective weight stack plate 100, 110, 120, 130, or 140. As shown in FIG. 15, each of the pins 621–625 includes a main beam 691 with an upwardly extending nub 693 on a distal end thereof.

Figure 16:
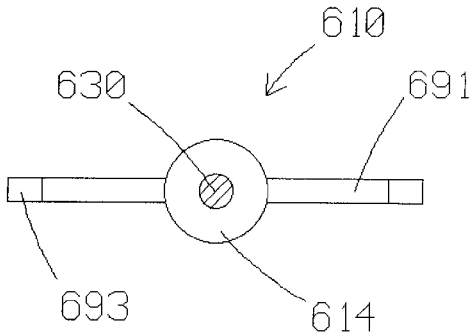
FIG. 16 is a top view of the selector rod of FIG. 13.

Looking at the top view of the selector rod 610 shown in FIG. 16, and the top view of the stacked plates shown in FIG. 12, one can see how the pins 621–625 may be rotated into alignment with any one of the pairs of weight plate tabs 206, 216, 226, 236, or 246 or the unobstructed openings 255. If the pins 621–625 are aligned with the openings 255, then none of the weight stack plates 100, 110, 120, 130, or 140 will be carried upward by the selector rod 610, and exercise (pulling on the cable 630) may be performed subject only to the weight of the selector rod 610.

Those skilled in the art will recognize that a top plate is typically rigidly secured to the selector rod to keep the selector rod aligned with the stack under all circumstances of operation (including the situation where no selector pin is inserted). Such a top plate may be added to the present invention to move up and down with the selector rod but nonetheless allow rotation of the selector rod relative to the stack. With the addition of a top plate, the minimal resistance setting will include the weight of such a top plate, as well (unless, of course, a counterbalance is provided).

If the pins 621–625 are aligned with the tabs 206 on the first weight stack plate 100, then exercise may be performed subject to the weight of the selector rod 610 and the uppermost weight stack plate 100. In this instance, the main beams 691 of the pins 621 engage first recesses 291 in the underside of the tabs 206, and the nubs 693 move through grooves 292 and into second recesses 293 (see FIG. 6). The recesses 291 cooperate with the main beams 691 to bias the weight stack plate 100 against rotation relative to the selector rod 610 during exercise movement. Similarly, the recesses 293 cooperate with the nubs to discourage both rotation and radial movement of the weight stack plate 100 relative to the selector rod 610 during exercise movement.

Figure 17:
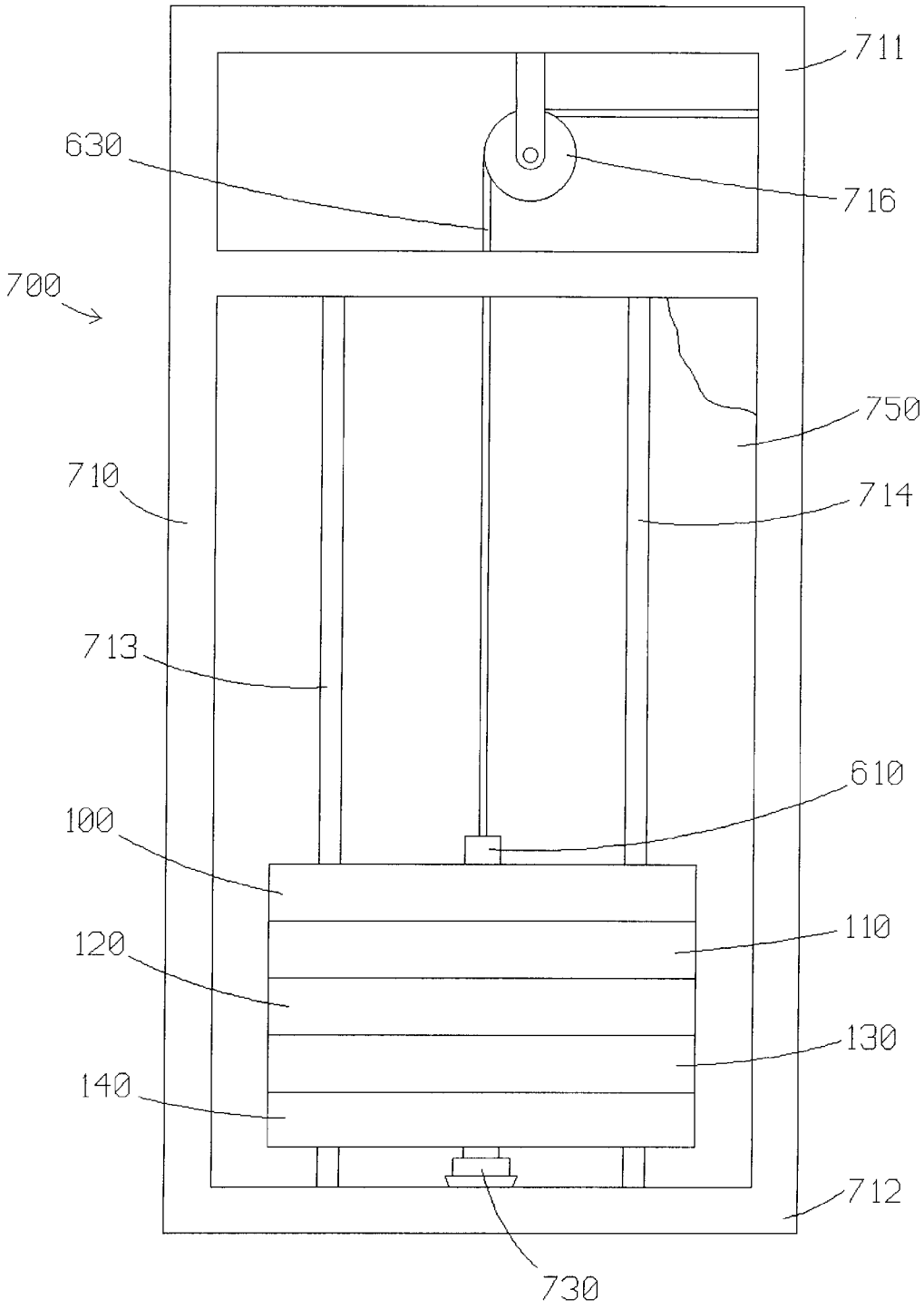
FIG. 17 is a front view of an exercise apparatus constructed according to the principles of the present invention and including the weight stack of FIG. 12 and the selector rod of FIG. 13.

The weight stack plates 100, 110, 120, 130, and 140 and the selector rod 610 are shown on an exercise apparatus 700 in FIG. 17. The exercise apparatus 700 includes a frame 710 having an upper end 711 and a lower end 712, with guide members or rods 713 and 714 extending vertically therebetween. The guide rods 713 and 714 extend through the holes 103 and 104, respectively, in the weights 101 and help to maintain alignment of the weight stack plates 100, 110, 120, 130, and 140 relative to one another. The cable 630 extends upward from the connector rod 610 to a pulley 716 which routes the cable 630 toward a force receiving member of any type known in the art. A unitary protective shield 750 may be secured across the entire side of the frame 710 and function as a partition between the stack of weights and any objects and/or people in the vicinity of the apparatus 700. An opaque shield may used to the extent that it is considered advantageous to hide the amount of weight being lifted.

Figure 18:
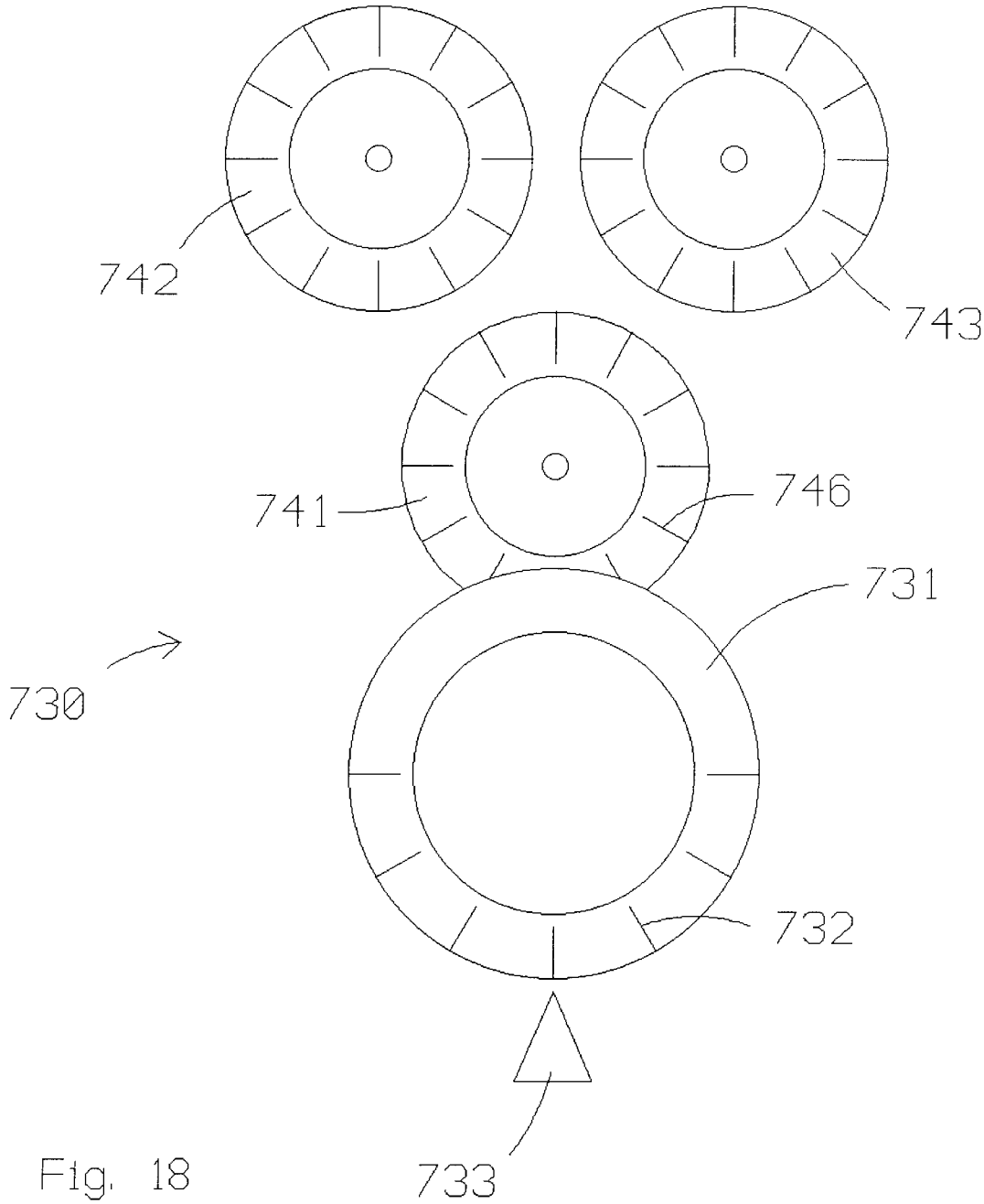
FIG. 18 is a top view of an adjustment assembly on the exercise apparatus of FIG. 17.
Figure 19:
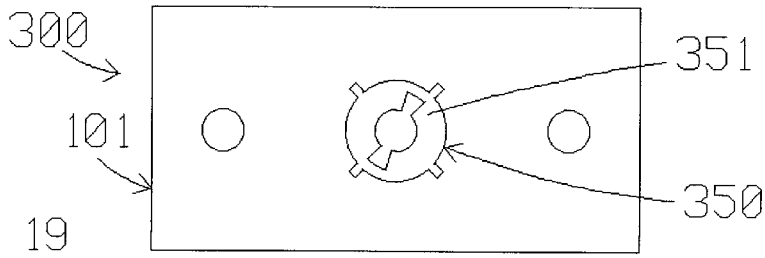
FIG. 19 is a top view of the weight stack plate of FIG. 2 and a second type of insert constructed according to the principles of the present invention.
Figure 20:
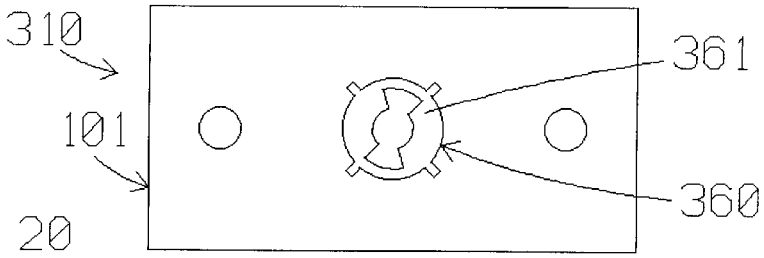
FIG. 20 is a top view of the weight stack plate of FIG. 2 and a second discrete insert of the type shown in FIG. 19.
Figure 21:
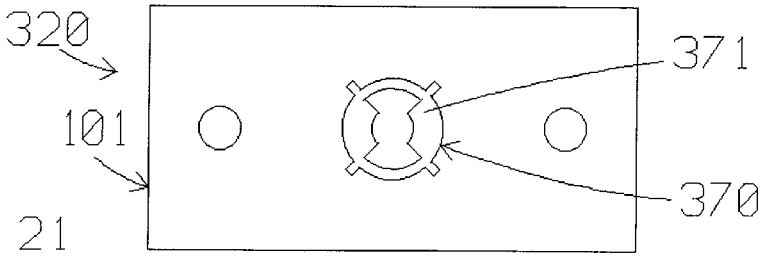
FIG. 21 is a top view of the weight stack plate of FIG. 2 and a third discrete insert of the type shown in FIG. 19.
Figure 22:
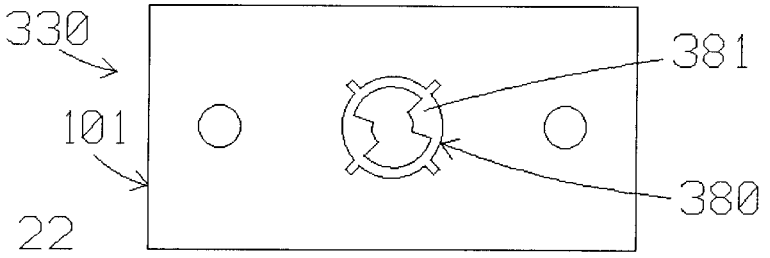
FIG. 22 is a top view of the weight stack plate of FIG. 2 and a fourth discrete insert of the type shown in FIG. 19.
Figure 23:
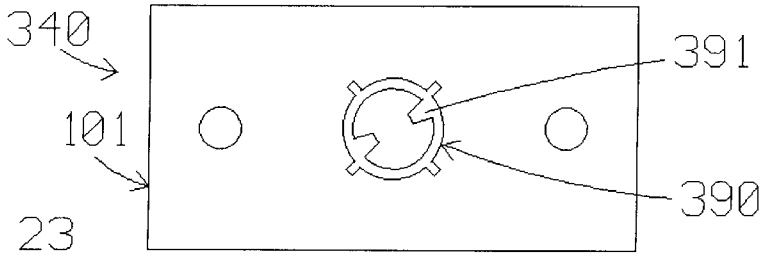
FIG. 23 is a top view of the weight stack plate of FIG. 2 and a fifth discrete insert of the type shown in FIG. 19.

The lower end 611 of the rod 610 engages a gear assembly 730 in the absence of a threshold amount of tension in the cable 630. The gear assembly 730 cooperates with the gear teeth 613 on the rod 610 to provide a means for rotating the rod 610 relative to the weight stack plates 100, 110, 120, 130, and 140. As shown in FIG. 18, three idler gears 741–743 are arranged in an equilateral triangle formation suitable for receiving the lower end 611 of the rod 600 in the center thereof. Each of the idler gears 741–743 is provided with gear teeth 746 which mate with the gear teeth 613 on the rod 610. Positioned adjacent the idler gear 741 is a knob 731 which has teeth that mate with the gear teeth 746 on the idler gear 741. As a result of this arrangement, rotation of the knob 731 causes rotation of the rod 610. Markings 732 on the knob 731 cooperate with a pointer 733 on the frame 710 to indicate the orientation of the pins 621–625 relative to the tabs 206, 216, 226, 236, and 246, and thereby indicate the amount of weight selected. Those skilled in the art will recognize that the knob 731 may be replaced by an automated device, such as a motor.

Those skilled in the art will also recognize that the foregoing description is merely illustrative, and that the present invention is not limited to the specifics thereof. For example, another, discrete type of weight stack plate is shown in FIGS. 19–24. These weight stack plates 300, 310, 320, 330, and 340 include the same weight 101 as the previous embodiment, but a different set of inserts. The alternative inserts 350, 360, 370, 380, and 390 are provided with respective tabs 351, 361, 371, 381, and 391, which are engaged by respective pins 621–625 whenever a relatively lower weight stack plate is engaged. For example, when the selector rod 610 is rotated to select the third highest weight stack plate 320, the pins 621 underlie the tabs 351, the pins 622 underlie the tabs 361, and the pins 623 underlie the tabs 371, while the pins 624 remain clear of the tabs 381, and the pins 625 remain clear of the tabs 391. An advantage of this particular arrangement is that the load of each weight stack plate is supported by a discrete set of pins.

Figure 24:
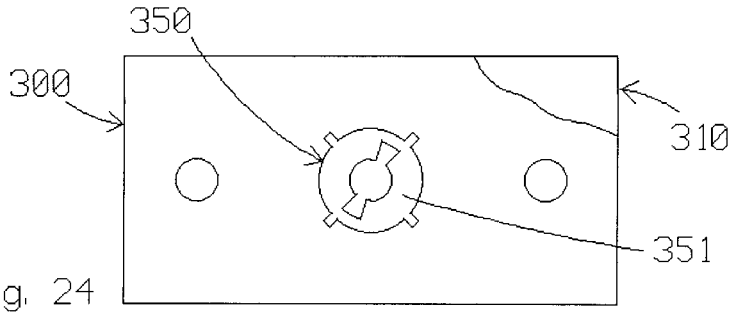
FIG. 24 is a top view of a weight stack comprising the weight stack plates and inserts of FIGS. 19–23, the weight stack plates having been stacked one on top of the other.
Figure 25:
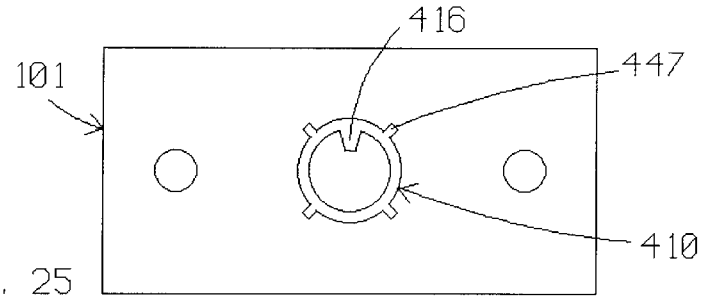
FIG. 25 is a top view of the weight stack plate of FIG. 2 and a third type of insert constructed according to the principles of the present invention.
Figure 26:
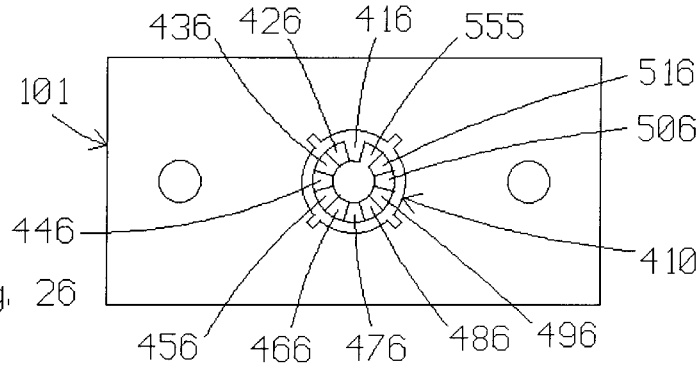
FIG. 26 is a top view of a weight stack including the weight stack plate and insert of FIG. 25 and ten additional weight stack plates and inserts stacked beneath those of FIG. 25.

Yet another, discrete type of weight stack plate is shown in FIGS. 25–26. These weight stack plates likewise include the same weight 101 as the previous embodiments and another, different set of inserts. The alternative inserts, one of which is designated as 410, are provided with respective tabs 416, 426, 436, 446, 456, 466, 476, 486, 496, 506, and 516, (as well as fins 447, for example) and are intended for use with a selector rod having only a single, radially extending selector pin at each discrete elevation. This particular embodiment gains the advantage of accommodating additional weight stack plates, but at the expense of engaging each plate in only a single sector (as opposed to diametrically opposed sectors). Those skilled in the art will recognize that the relatively higher inserts in this embodiment may be modified to function like those shown in FIGS. 19–24, so that the load from multiple weight stack plates is distributed among respective pins.

Figure 27:
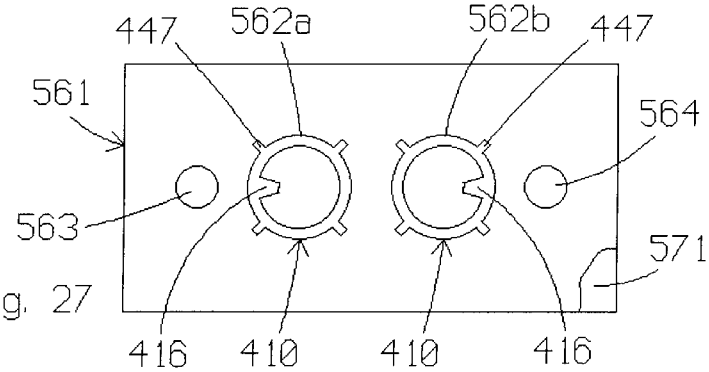
FIG. 27 is a top view of a weight comprising a different type of weight stack plate and two inserts of the type shown in FIG. 25.

Still another, discrete type of weight stack plate is shown in FIG. 27. These weight stack plates, two of which are designated as 561 and 571, require a different type of weight, but inserts similar to those shown in FIG. 25. The weight itself has two relatively larger openings 562*a* and 562*b*, in addition to two guide rod holes 563 and 564. Each larger opening 562*a* and 562*b* is configured similar to the opening 102 shown in FIGS. 2–3. In this embodiment, all of the inserts 410 are identical to that shown in FIG. 25, and all are inserted into their respective weights at the same orientation shown in FIG. 27. As a result, all tabs 416 within a respective column of inserts are aligned with one another (or occupy a single sector).

Figure 28:
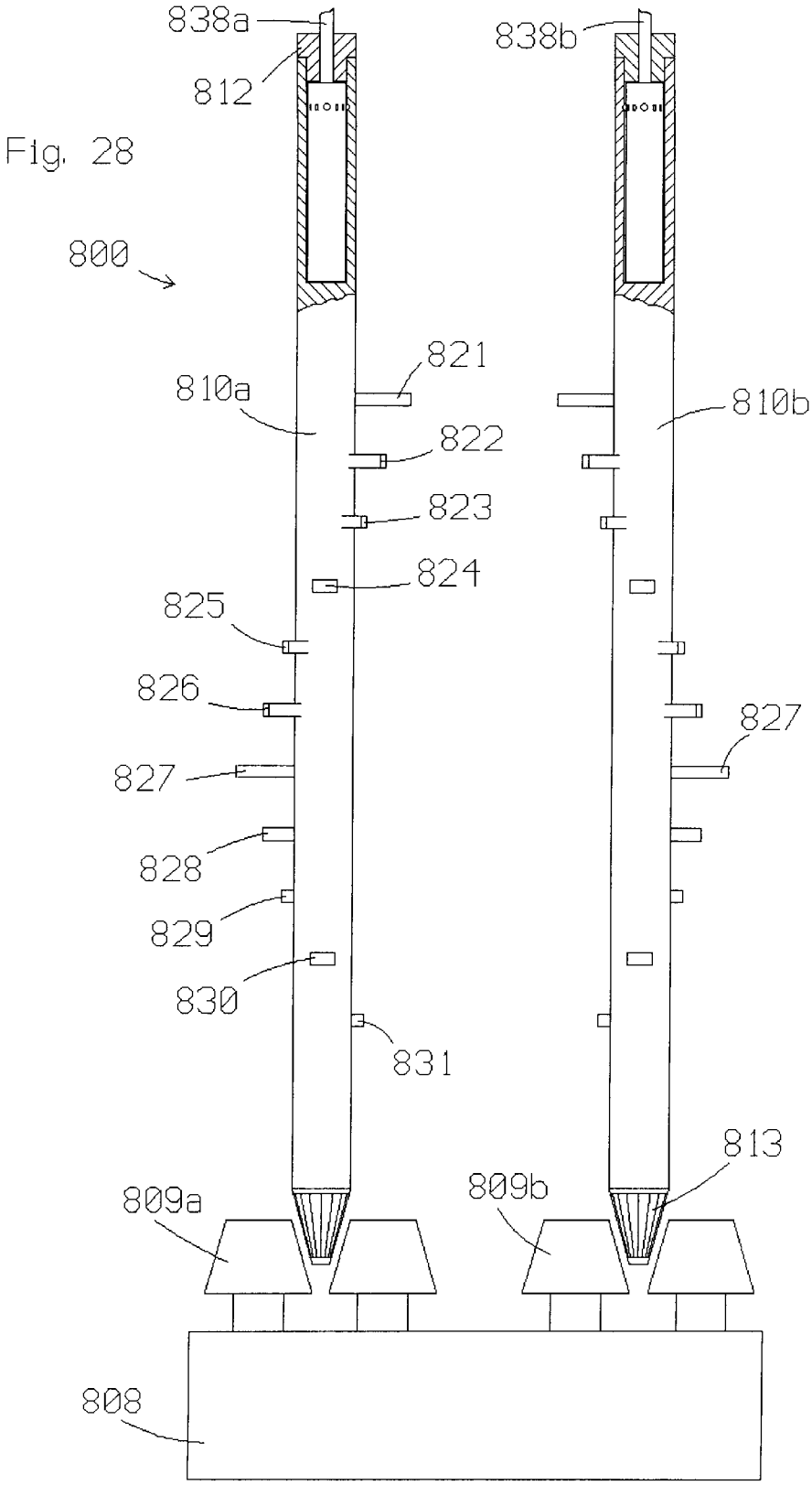
FIG. 28 is a front view of a pair of selector rods constructed according to the principles of the present invention and suitable for use together with the weight of FIG. 27.

The selector assembly for this embodiment is designated as 800 in FIG. 28. The selector assembly 800 includes two selector rods 810*a* and 810*b* which are rotated in opposite directions by a motorized gear box 808 (in response to signals generated by a controller, for example). Those skilled in the art will recognize that a variety of methods and apparatus are available for such a purpose. Examples of automatic and/or remotely controlled weight selection are disclosed in U.S. Pat. No. 5,037,089 to Spagnuolo et al. and U.S. Pat. No. 4,546,971 to Raasoch, which are incorporated herein by reference to same. Each selector rod 810*a* and 810*b* has threads 813 on its lower end which interengage with respective gears 809*a* and 809*b* on the motorized gear box 808. Each selector rod 810*a* and 810*b* has an upper end 812 similar to that on the selector rod 610 shown in FIGS. 13–14. The cables 838*a* and 838*b* extend upward and are connected to respective pulleys which, in turn, are keyed to a common shaft. An additional cable is connected to a separate pulley on the shaft and then routed to an exercise member.

Each selector rod 810*a* and 810*b* also has pins 821–831 extending radially outward into discrete sectors about a respective rod. Rotation of the rods 810*a* and 810*b* brings opposing pairs of pins 821–831 into alignment with the tabs 416 on successively lower (or higher) weight stack plates. This embodiment may be seen to be advantageous because only a single insert configuration is required, and/or the selected weight stack is supported at two discrete locations, despite the accommodation of a greater number of weight stack plates.

Another embodiment of the present invention combines the foregoing cable and pulley arrangement with each of two discrete weight stacks configured to require only a single selector rod. In other words, a first cable extends upward from a first selector rod to a first pulley, and a second cable extends upward from a second selector rod to a second pulley. The first selector rod inserts through seven weight stack plates weighing five pounds each and disposed in a first stack, and the second selector rod inserts through seven weight stack plates weighing forty pounds each and disposed in a second stack. In this example, the amount of resistance can be varied in five pound increments from five pounds to three hundred and fifteen pounds. Another variation is to rotatably mount the two selector rods on a single carriage, which in turn, is suspended from a single cable that extends all the way to the exercise member.

Figure 29:
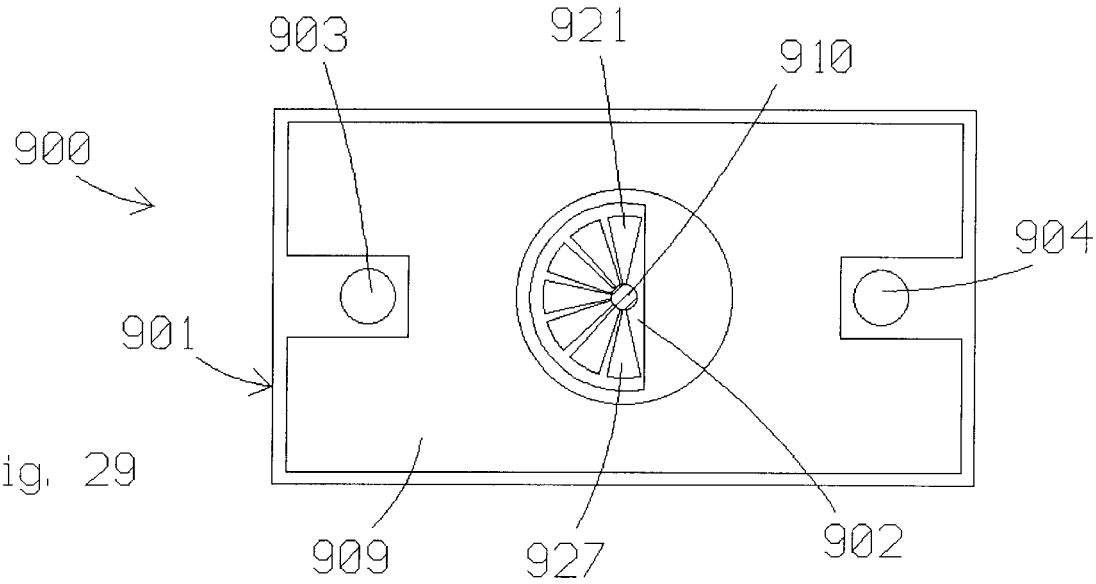
FIG. 29 is a partially sectioned top view of a stack of weights of yet another type, with a selector rod occupying a first orientation relative to the weights in the stack.
Figure 30:
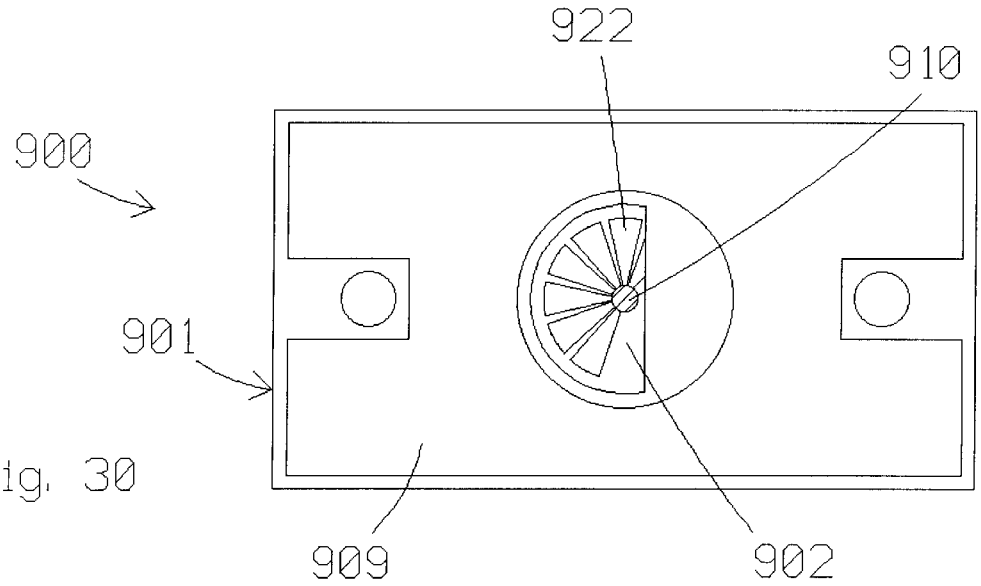
FIG. 30 is a partially sectioned top view of the weight stack of FIG. 29, with the selector rod occupying a second, discrete orientation relative to the weights in the stack.
Figure 31:
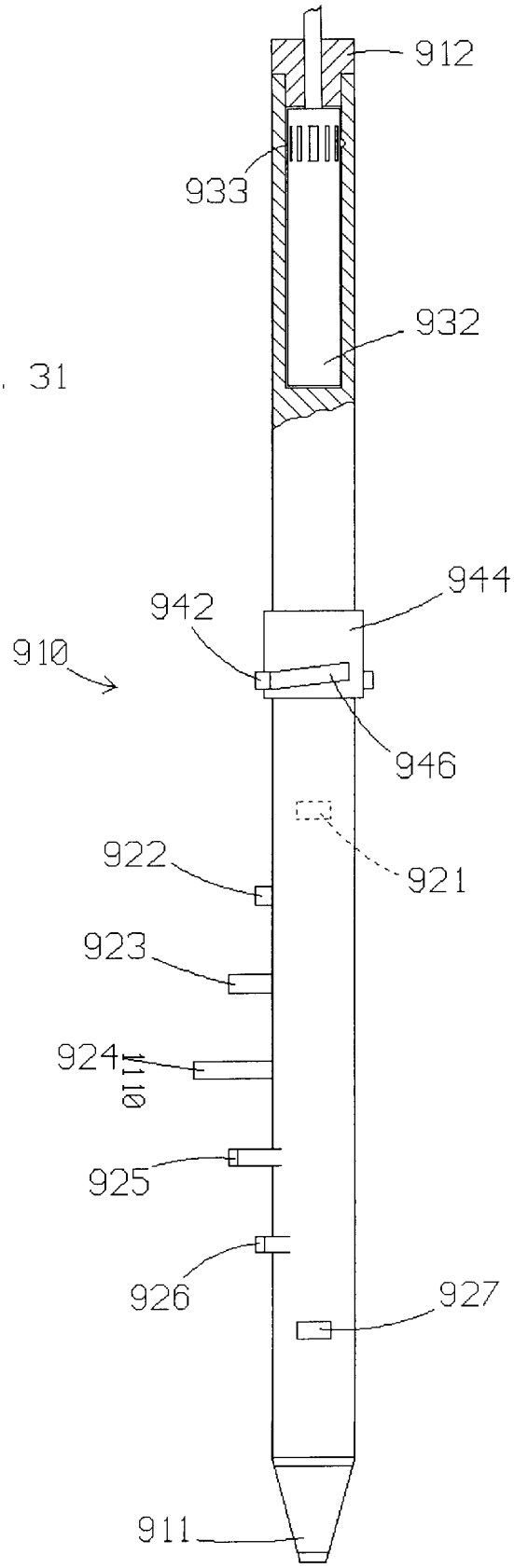
FIG. 31 is a front view of the selector rod of FIG. 29.

Yet another embodiment of the present invention is shown in FIGS. 29–31. A weight stack plate 900 includes a weight 901 without any insert. The weight 901 is generally rectangular in shape and is made from a relatively heavy and durable material, such as steel. Circular holes 903 and 904 are formed through the weight 901, proximate opposite ends thereof, to receive guide members or rods in a manner known in the art. A relatively larger opening 902 is formed through the center of the weight 901 to accommodate a selector rod 910. The central opening 902 is generally semi-circular, defining a sector of somewhat more than 180 degrees, and it extends straight down through the weight 901. A generally H-shaped depression 909 is formed in the top of the weight 901 to accommodate a generally H-shaped spacer 999 which is made of rubber (or other suitable shock-absorbing material).

The selector rod 910 extends between a first, lower end 911 and a second, upper end 912. The upper end 912 is similar to that on the selector rod 610, and it accommodates a shaft 932 having slots 933 formed therein, proximate the upper end thereof. The slots 933 similarly cooperate with a ball detent to bias the rod 910 toward discrete orientations, while also allowing for slight axial movement of the rod 910 relative thereto. The lower end 911 is generally pointed but lacks the gear teeth of the selector rod 610. Selector pins 921–927 extend radially outward from the selector rod 910 in discrete sectors disposed about the rod. Each of the pins 921–927 is disposed immediately beneath a respective weight stack plate, like the one designated as 900.

Looking at the top view of the selector rod 910 and weight stack plate 900 shown in FIG. 29, one can see that the rod 910 may occupy an orientation wherein all of the pins 921–927 are free of the weight stack plates, in which case exercise may be performed subject only to the weight of the selector rod 910 (and any top plate). Looking at the top view shown in FIG. 30, one can see that the rod 910 may be rotated, by hand for example, to an orientation wherein the pin 921 underlies the uppermost weight stack plate. The selector rod 910 may be rotated further to place additional pins 922–927 under successively lower plates.

As shown in FIG. 31, locking pins 942 extend radially outward from the selector rod 910 at diametrically opposed locations. A collar 944 is rotatably mounted on the selector rod 910, with the locking pins 942 extending through respective slots 946 in the collar 944. The lower end of the collar 944 occupies a position adjacent the uppermost weight stack plate, and the slots 946 extend at an angle relative thereto. Once the desired number of weight stack plates has been selected, the collar 944 may be rotated to clamp the selected weights together.

The stability of the selected weights is further enhanced by providing ridges and/or recesses in the underside of the weight stack plates to selectively engage the selector pins 921–927 and discourage rotation of the latter relative to the former except when the collar 944 is loosened. Another option is to provide angled bearing surfaces on the pins 921–927 which will tend to push upward on respective weight stack plates upon rotation into engagement therewith.

Yet another variation of the present invention is to eliminate the central opening through each weight stack plate and dispose the selector rod(s) outside the planform of the plates. Pins on the rod(s) may be selectively rotated beneath respective plates to engage same. In other words, those skilled in the art will recognize that the present invention is not limited to selector rods which insert through the plates in a weight stack.

Figure 32:
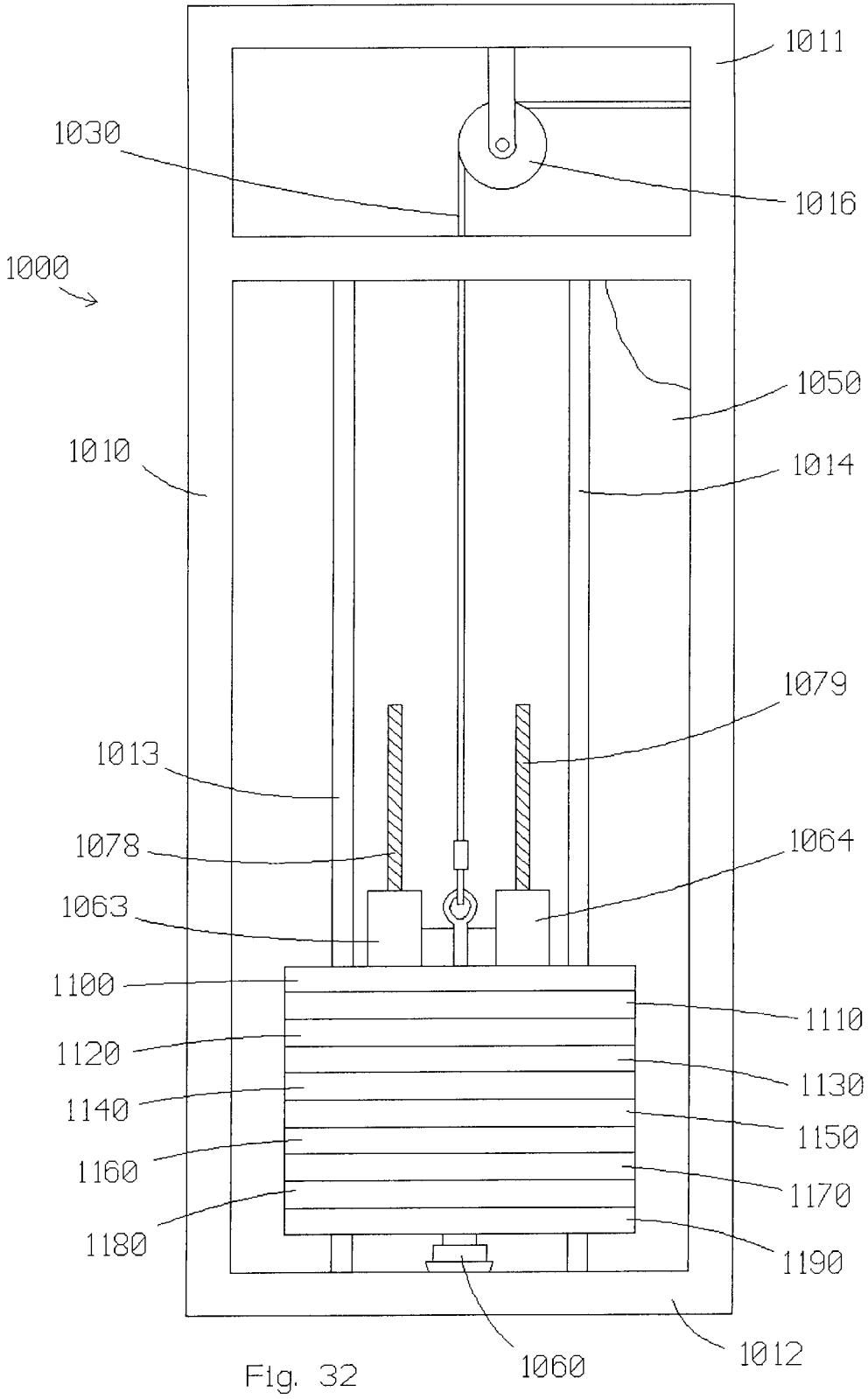
FIG. 32 is partially sectioned front view of another weight stack exercise apparatus constructed according to the principles of the present invention.

Still another "rotating selector rod" weight stack constructed according to the principles of the present invention is designated as 1000 in FIG. 32. The exercise apparatus 1000 includes a frame 1010 having an upper end 1011 and a lower end 1012, with guide members or rods 1013 and 1014 extending vertically therebetween. The guide rods 1013 and 1014 extend through holes 1103 and 1104 (see FIGS. 33–34), respectively, in each of the weight stack plates 1100, 1110, 1120, 1130, 1140, 1150, 1160, 1170, 1180, and 1190 to maintain alignment of the weights. A fastener 1102 extends upward from the uppermost weight 1100, and a cable 1030 extends upward from the fastener 1102. The cable 1030 is routed about a pulley 1016 and proceeds to a force receiving member of any type known in the art. A shock-absorbing bumper 1060 is disposed beneath the weight stack to absorb impact from descending weights. A unitary protective shield 1050 may be secured across the entire side of the frame 1010 and function as a partition and/or shroud between the stack of weights and any people in the vicinity of the apparatus 700.

Figure 33:
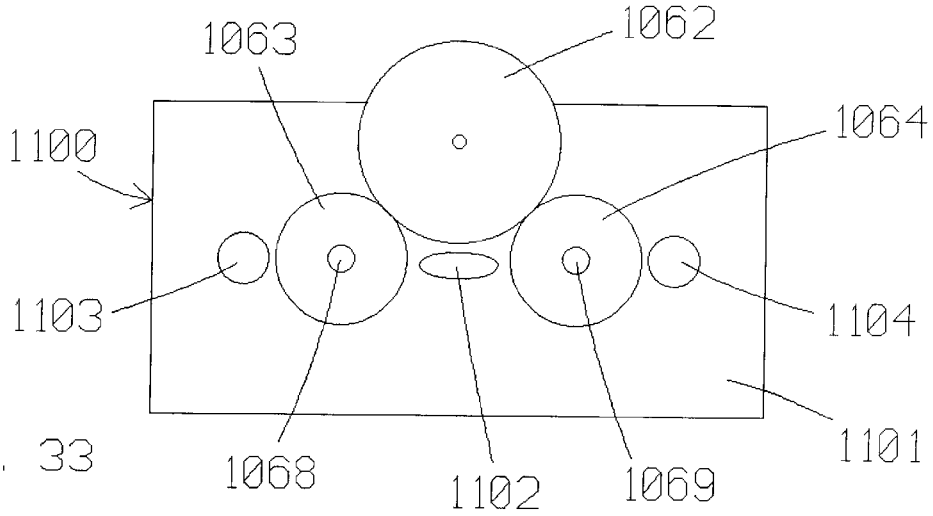
FIG. 33 is a top view of a weight adjustment assembly and uppermost weight stack plate on the apparatus of FIG. 32.
Figure 34:
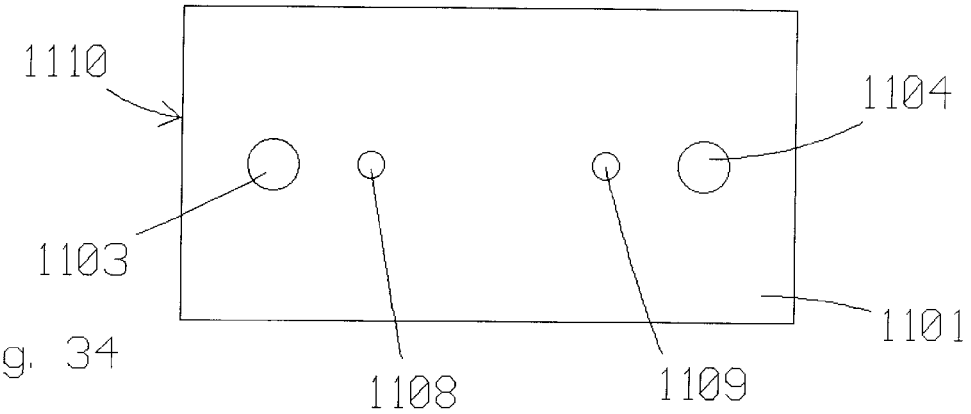
FIG. 34 is a top view of a relatively lower weight stack plate on the apparatus of FIG. 32.

As shown in FIG. 33, a motor driven roller 1062 is rotatably mounted on the uppermost weight stack plate 1100 together with rollers 1063 and 1064. Threaded holes 1068 and 1069 are formed through respective rollers 1063 and 1064 to mate with exterior threads on respective shafts 1078 and 1079. As shown in FIG. 34, threaded holes 1108 and 1109 are formed through each of the weights 1101 to likewise receive respective shafts 1078 and 1079. Rotation of the motor driven roller 1062 causes rotation of the rollers 1063 and 1064, thereby moving the shafts 1078 and 1079 downward or upward, into or out of engagement with the threaded holes 1108 and 1109 in any number of plates. Interengaging gear teeth may be provided at the interfaces between the rollers 1063 and 1064 and the motor driven roller 1062 to facilitate rotational transmission therebetween.

Figure 35:
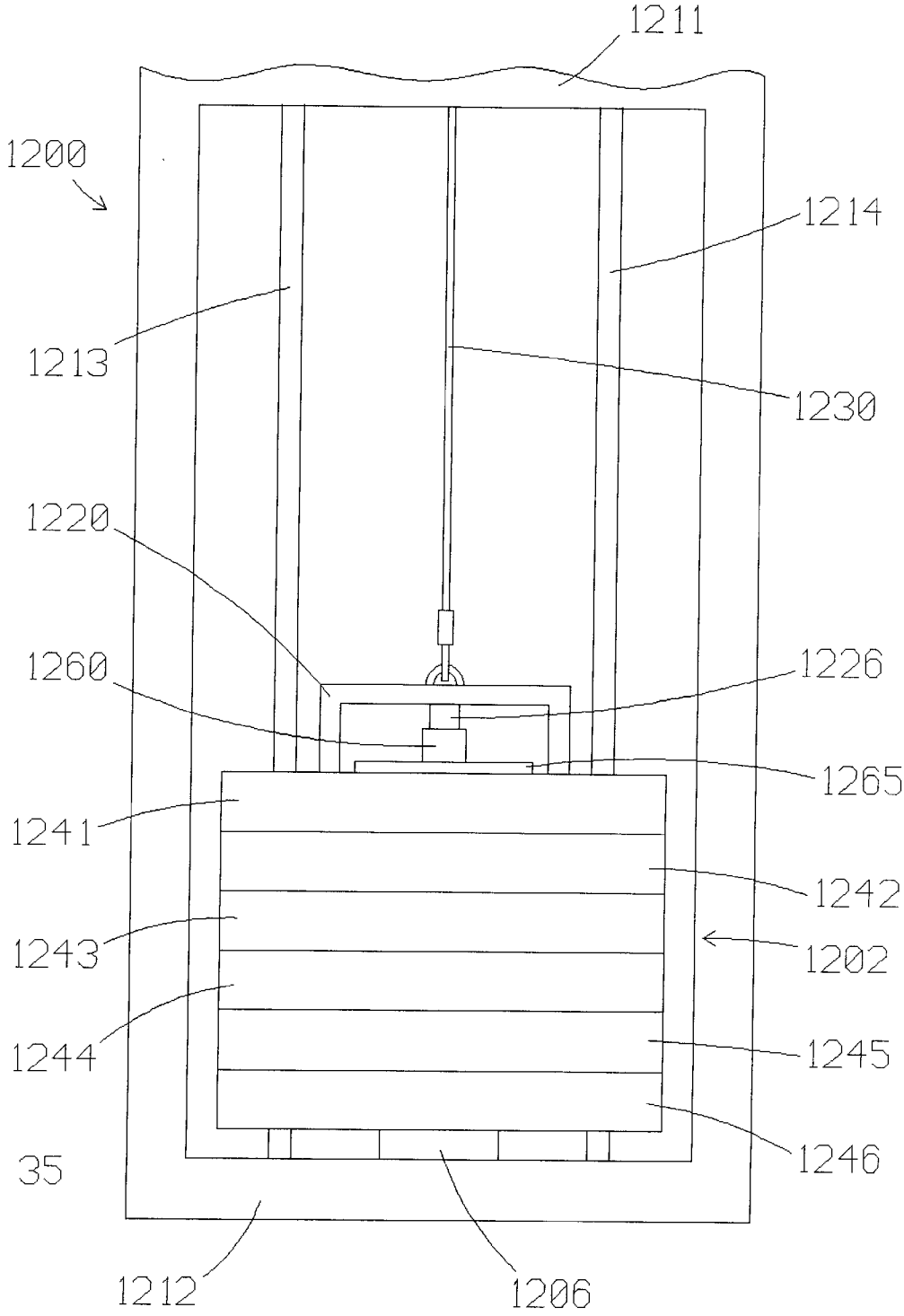
FIG. 35 is a fragmented front view of another weight stack exercise apparatus constructed according to the principles of the present invention.

FIG. 35 shows a weight stack exercise apparatus 1200 which combines aspects of the previous embodiment 1000 and the weight stack shown in FIG. 24. A weight stack 1202 is supported by a pair of guide rods 1213 and 1214 which extend between an upper frame portion 1211 and a lower frame portion 1212. A shock absorbing bumper 1206 is disposed between the weight stack 1202 and the lower frame portion 1212. A bracket 1220 is secured to the uppermost weight stack plate 1241, and a flexible connector 1230 is secured between the bracket 1220 and a force receiving member (not shown).

A selector rod 1260 is rotatably mounted to the uppermost weight stack plate 1241. The selector rod 1260 selectively engages the weights 1241–1246 in the stack 1202 in much the same manner as the selector rod 610 cooperates with the weight stack shown in FIG. 24. A shaft 1226 is rigidly secured to the bracket 1220 and extends downward into the selector rod 1260 to keep the latter in alignment with the weight stack 1202. A plate 1265 is rigidly secured to the selector rod 1260 to transmit the weight of the rod 1260 and any engaged lower weights 1242–1246 to the uppermost weight 1241.

Figure 36:
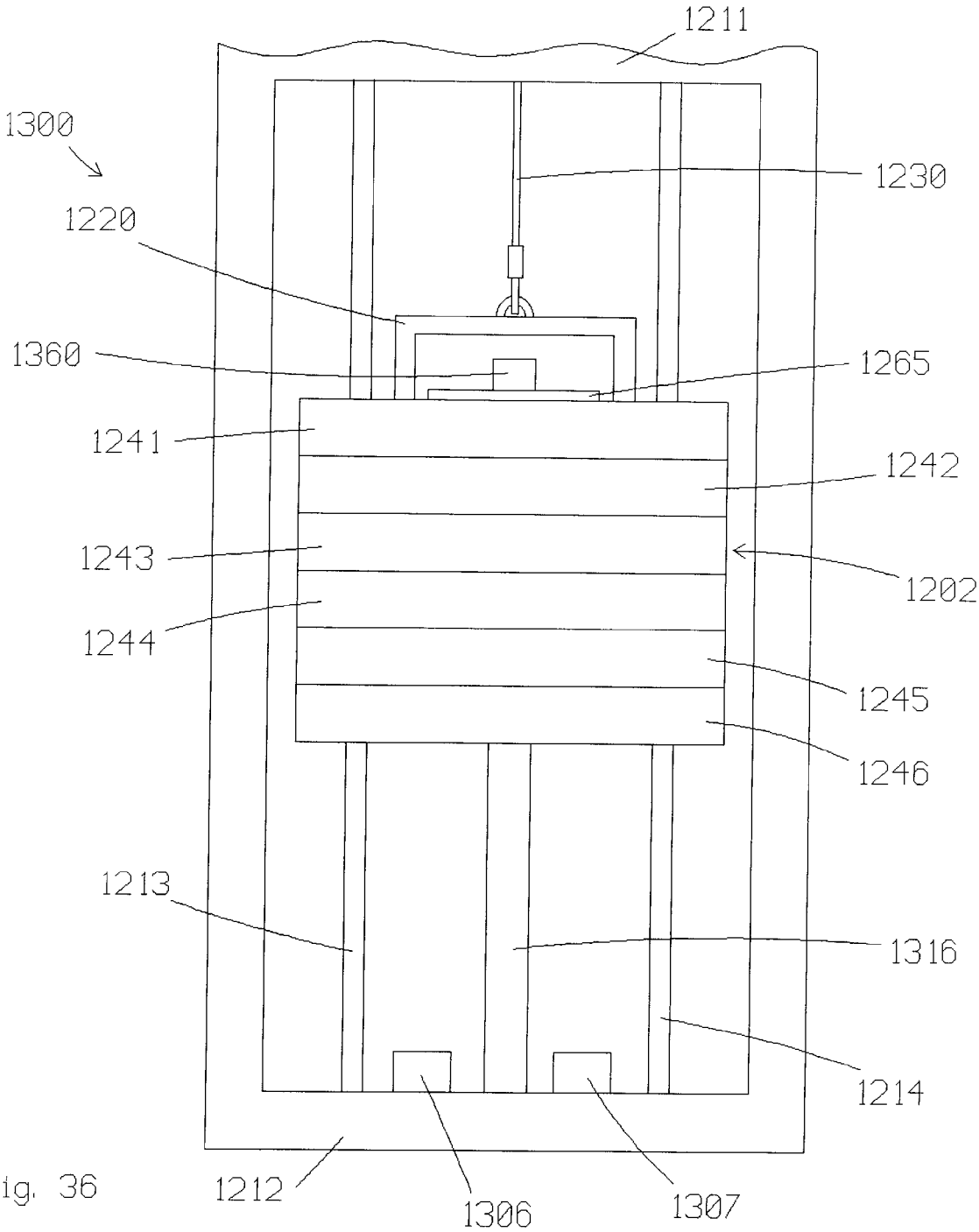
FIG. 36 is a fragmented front view of yet another weight stack exercise apparatus constructed according to the principles of the present invention.

FIG. 36 shows an exercise apparatus 1300 similar in many respects to the foregoing embodiment 1200, as suggested by the common reference numerals. However, a pair of shock absorbing bumpers 1306 and 1307 are substituted for the shock absorbing bumper 1206, and a frame mounted shaft 1316 is provided to keep the selector rod 1360 in alignment with the weight stack 1202. The shaft 1316 preferably includes spring-biased, telescoping sections to accommodate upward travel of the weights 1241–1246 over a distance greater than the height of the stack 1202.

Figure 37:
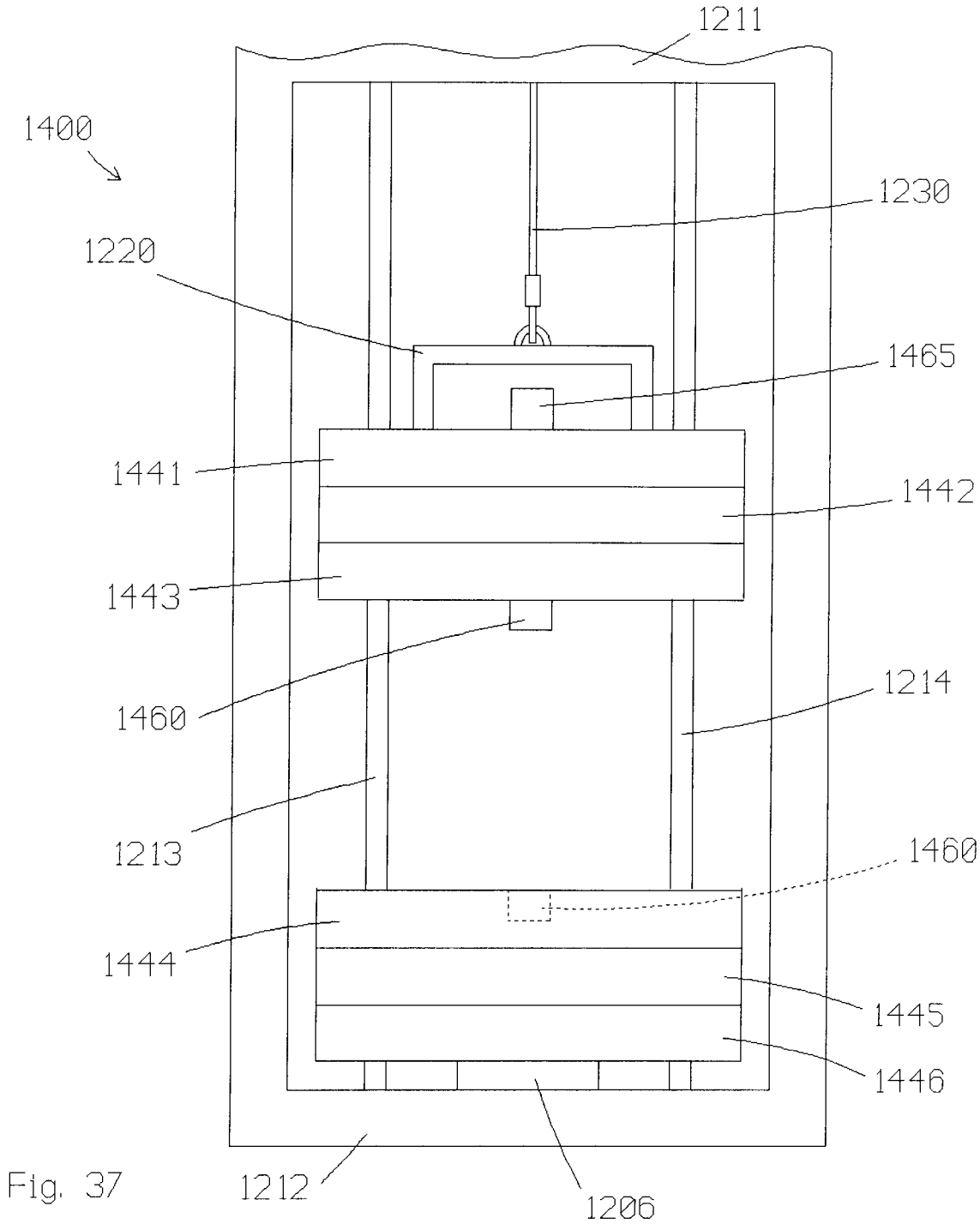
FIG. 37 is a fragmented front view of still another weight stack exercise apparatus constructed according to the principles of the present invention.

FIG. 37 shows an exercise apparatus 1400 similar in some respects to the foregoing embodiments 1200 and 1300, as suggested by the common reference numerals. However, a stack of different weights 1441–1446 has been substituted for the weight stack 1202. In particular, each of the weights 1441–1445 has its own centrally mounted selector rod 1460 which is selectively rotatable into and out of engagement with its counterpart on an underlying weight stack plate. In particular, each selector rod 1460 has an upper portion and a lower portion, and the former is sized and configured to receive the latter. For example, the lower portion of the selector rod 1460 on the third highest plate 1443 protrudes downward beneath the plate 1443 and into engagement with an upper portion of the selector rod 1460 on the fourth highest plate 1444.

A knob 1465 is secured to the upper portion of the selector rod 1460 on the uppermost plate 1441 to facilitate selection of the desired number of plates. Rotation of the knob 1465 a first amount in a first direction causes the uppermost selector rod 1460 to engage the second highest selector rod 1460. Rotation of the knob 1465 an additional amount in the first direction causes the next highest selector rod 1460 to engage the third highest selector rod 1460, and so on. Rotation of the knob 1465 as far as allowed in a second, opposite direction ensures that all of the selector rods 1460 are disengaged from one another. The likelihood of engaging a relatively lower weight prematurely may be reduced by requiring a minimum amount of torque to rotate the selector rods 1460.

A further variation of the present invention is to "fish" for the desired number of weight stack plates by moving the selector rod up or down and then rotating into engagement with the desired weight. Numerous other embodiments and/or modifications will become apparent to those skilled in the art as a result of this disclosure. For example, more or less weight stack plates may be added to a stack by altering the size and/or configuration of the pins. The foregoing description and accompanying figures are limited to only a few of the possible combinations and/or embodiments to be constructed in accordance with the principles of the present invention. To the extent not incompatible, any of the rotating selector rod embodiments may be combined with any of the side loaded embodiments.

With reference to the embodiments discussed above, the present invention may also be described in terms of various methods, including, for example, a method of providing adjustable resistance to exercise, comprising the steps of disposing weights on opposite first and second sides of a base member; movably mounting first and second bars on the base member; moving the first bar in a first direction relative to the base member and into engagement with a desired number of the weights on the first side of the base member; and moving the second bar in a second, opposite direction relative to the base member and into engagement with a desired number of the weights on the second side of the base member.

This method may further involve the steps of providing a hole through each of the weights on the first side of the base member to receive the first bar, and providing a hole through each of the weights on the second side of the base member to receive the second bar. Also, a groove may be provided in each of the weights on the first side of the base member to accommodate the second bar, and a groove may be provided in each of the weights on the second side of the base member to accommodate the first bar. The first bar and the second bar may be constrained to engage a like number of weights and/or to move together in opposite directions. Such constraints may involve provision of racks of gear teeth on the first bar and the second bar, and mounting of a rotary gear on the base member between the racks on the first bar and the second bar.

The method may also involve the step of maintaining each of the weights a fixed distance from the base member and/or maintaining each of the weights a fixed distance from adjacent weights. In this regard, weight spacers may be provided on the base member and/or on the weights themselves, and they may even extend between the weights on the first side of the base member and the weights on the second side of the base member.

Further steps may include attaching a plastic support to each of the weights to facilitate engagement by a respective bar, and/or providing a housing sized and configured to accommodate the base member and the weights and to support any non-engaged weights upon removal of the base member.

A handle may be provided on the base member, preferably disposed between the weights on the first side and the weights on the second side. A groove may be provided in each of the weights to accommodate the handle, and/or the base member and the weights may be configured to collectively define keyways sized and configured to receive the first bar and the second bar.

The weights may be constrained to move through defined paths. Furthermore, additional weights may be disposed in a stack beneath the base member, and a selector rod may be inserted through the stacked weights. Moreover, the selector rod may be configured to rotate into engagement with a desired number of stacked weights. In this case, a rack of gear teeth may be provided on each of the first bar and the second bar; a gear may be rotatably mounted on the base member between the rack on the first bar and the rack on the second bar (to constrain the first bar and second bar to move in opposite directions); and the output shaft of a motor may be moved from a first position, engaging the gear, to a second position, engaging the selector rod.

Additionally, the present invention may be seen to provide a method of providing adjustable resistance to exercise, involving the arrangement of a plurality of weights into a stack; and the rotation of a selector rod relative to the stack to engage a desired weight within the stack. This method may further involve providing holes through the weights to receive the selector rod; having the selector rod occupy all such holes during rotation, regardless of which weight is the desired weight; rotating the selector rod a fraction of a revolution to engage an additional weight; threading the selector rod into engagement with the desired weight; compressing the desired weight against an uppermost weight and any intermediate weights; rotating the selector rod about its longitudinal axis until a radially extending pin underlies a portion of the desired weight; and/or having the selector rod engage any weight disposed above the desired weight, as well as the desired weight itself.

The present invention may also be seen to provide a method of adjusting resistance to exercise, involving the arrangement of a plurality of weights into a stack; the rotation of a selector rod a first amount relative to the stack to engage a first weight within the stack; and rotation of the selector rod a second amount relative to the stack to engage a second weight within the stack. This method may further involve threading the selector rod into each weight to be engaged; clamping all the engaged weights together; rotating a selector rod in the first weight the second amount to engage a selector rod on the second weight; rotating the selector rod about its longitudinal axis until a radially extending pin underlies a portion of the second weight; and/or separately engaging the first weight and the second weight.

Those skilled in the art will also recognize that features of various methods and/or embodiments may be mixed and matched in numerous ways to arrive at still more variations of the present invention. Recognizing that those skilled in the art are likely to recognize many such variations, the scope of the present invention is to be limited only to the extent of the following claims.

What is claimed is:

1. A variable weight exercise system, comprising:

a stationary weight holder;

a plurality of weights stored on said weight holder with gaps defined between adjacent weights;

a movable base having intermittently spaced supports configured and arranged to extend within respective gaps between respective weights as said base is moved toward said weight holder; and at least one selector rod mounted on said base and selectively movable into aligned openings in said supports and said weights, wherein a desired number of said weights may be secured to said base and removed from said weight holder.

2. The exercise system of claim 1, wherein some of said supports are disposed at a first end of said base, and some of said supports are disposed at an opposite, second end of said base.

3. The exercise system of claim 2, wherein said at least one selector rod includes a first selector rod and a second selector rod.

4. The exercise system of claim 3, wherein said first selector rod is movable through said supports at said first end of said base and through said weights disposed adjacent thereto, and said second selector rod is movable through said supports at said second end of said base and through said weights disposed adjacent thereto.

5. The exercise system of claim 4, wherein said first selector rod and said second selector rod are mounted on opposite sides of said base.

6. The exercise system of claim 4, further comprising a means, on said base, for constraining said first selector rod and said second selector rod to move in opposite directions.

7. The exercise system of claim 2, wherein said at least one selector rod includes a rigid bar that is movable from a first position, spanning at least one of said supports at said first end of said base, to a second position, spanning at least one of said supports at said second end of said base.

8. The exercise system of claim 7, wherein each of said supports is configured to accommodate passage of a portion of said bar.

9. The exercise system of claim 2, wherein said base includes a handle sized and configured for grasping, and said handle is disposed between said supports at said first end of said base, and said supports at said second end of said base.

10. The exercise system of claim 9, wherein said at least one selector rod includes a first selector rod and a second selector rod.

11. The exercise system of claim 10, wherein said first selector rod is movable through said openings in said supports at said first end of said base, and said second selector rod is movable through said openings in said supports at said second end of said base.

12. The exercise system of claim 11, wherein said first selector rod and said second selector rod are mounted on opposite sides of said base.

13. The exercise system of claim 11, further comprising a means, on said base, for constraining said first selector rod and said second selector rod to move in opposite directions.

14. The exercise system of claim 9, wherein said at least one selector rod includes a rigid bar that is movable from a first position, spanning at least one of said supports at said first end of said base, to a second position, spanning at least one of said supports at said second end of said base.

15. The exercise system of claim 14, wherein each of said supports is configured to accommodate a portion of said bar.

16. The exercise system of claim 1, wherein some of said weights are stored at a first end of said weight holder, and some of said weights are stored at an opposite, second end of said weight holder, and said base includes an elongate handlebar having an intermediate portion sized and configured for grasping, a first end that spans the weights stored at said first end of said weight holder, and an opposite, second end that spans the weights stored at said second end of said weight holder.

17. The exercise system of claim 16, wherein each of said weights has an outwardly opening slot sized and configured to receive a respective portion of said handlebar.

18. The exercise system of claim 17, wherein some of said supports extend radially outward from said first end of said handlebar, and some of said supports extend radially outward from said second end of said handlebar.

19. The exercise system of claim 18, wherein said at least one selector rod includes both a first rigid bar that is selectively movable through the supports on said first end of said handlebar and through respective weights on said first end of said weight holder, and a second rigid bar that is selectively movable through the supports on said second end of said handlebar and through respective weights on said second end of said weight holder.

20. A variable weight exercise dumbbell having a first weight and a second weight stored adjacent one another, and a base having an axially movable selector rod, the improvement comprising:

an opening extending through said first weight, and an opening extending through said second weight, wherein each said opening is axially aligned with said selector rod;

a shoulder protruding outward from at least one said weight and toward the other said weight at a location apart from each said opening; and a gap, having an axial dimension at least as great as said shoulder, defined between said opening in said first weight and said opening in said second weight, wherein said selector rod is selectively movable from a first position, removed from each said weight, to a second position, extending through said opening in said first weight and into said gap between said first weight and said second weight.

* * * * *